US010167698B2

(12) United States Patent
Rosenthal

(10) Patent No.: US 10,167,698 B2
(45) Date of Patent: Jan. 1, 2019

(54) CONFIGURABLE BRIDGE PLUG APPARATUS AND METHOD

(71) Applicant: GEODynamics, Inc., Millsap, TX (US)

(72) Inventor: Wayne Rosenthal, Millsap, TX (US)

(73) Assignee: GEODYNAMICS, INC., Millsap, TX (US)

( * ) Notice: Subject to any disclaimer, the term of this patent is extended or adjusted under 35 U.S.C. 154(b) by 442 days.

(21) Appl. No.: 15/140,264

(22) Filed: Apr. 27, 2016

(65) Prior Publication Data

US 2017/0314361 A1 Nov. 2, 2017

(51) Int. Cl.

| | |
|---|---|
| ***E21B 33/134*** | (2006.01) |
| ***E21B 33/12*** | (2006.01) |
| ***E21B 33/129*** | (2006.01) |

(52) U.S. Cl.

CPC ..... *E21B 33/134* (2013.01); *E21B 33/12* (2013.01); *E21B 33/129* (2013.01)

(58) Field of Classification Search

CPC ..... E21B 33/134; E21B 33/129; E21B 33/14; E21B 33/12; E21B 34/14; E21B 34/063; E21B 34/08; E21B 2034/002; E21B 2034/005

See application file for complete search history.

(56) References Cited

U.S. PATENT DOCUMENTS

| | | | | |
|---|---|---|---|---|
| 5,224,540 | A | 7/1993 | Streich et al. | |
| 7,740,079 | B2 | 6/2010 | Clayton et al. | |
| 8,127,856 | B1 | 3/2012 | Nish et al. | |
| 8,267,177 | B1 | 9/2012 | Vogel et al. | |
| 2010/0263876 | A1 | 10/2010 | Frazier | |
| 2011/0232899 | A1 | 9/2011 | Porter et al. | |
| 2011/0277989 | A1 | 11/2011 | Frazier | |
| 2011/0290473 | A1 | 12/2011 | Frazier | |
| 2012/0006532 | A1 | 1/2012 | Frazier | |
| 2012/0125642 | A1 | 5/2012 | Chenault et al. | |
| 2012/0279700 | A1 * | 11/2012 | Frazier | E21B 33/129 166/193 |

* cited by examiner

*Primary Examiner* — George S Gray

(74) *Attorney, Agent, or Firm* — Patent Portfolio Builders PLLC

(57) ABSTRACT

A configurable composite bridge plug apparatus and method for converting bridge plugs into frac plugs in the field of operation is disclosed. The bridge plug apparatus includes a body with a cylindrical hollow inner mandrel, an upper threaded end and a lower threaded end. A release ring with threads disposed on an outer surface is attached to the upper threaded end. An upper restriction element and a lower restriction element plug both ends of the hollow inner mandrel so that flow is restricted in either directions. A stand-off pin holds the lower restriction element in place. A ball seat inserted proximally to the upper restriction element towards the upper threaded end. A cage retainer is attached to the ball seat with a ball. The configurable bridge plug transformed to a frac plug by removing the upper restriction element and the lower restriction element from the bridge plug.

14 Claims, 21 Drawing Sheets

1000

CONFIGURABLE BRIDGE PLUG APPARATUS AND METHOD

FIELD OF THE INVENTION

The present invention generally relates to oil and gas extraction. Specifically, the invention attempts to isolate fracture zones through selectively positioning restriction elements within a wellbore casing. More specifically, it relates to bridge plugs that can be converted into any of the frac plug variants in the field of operations.

PRIOR ART AND BACKGROUND OF THE INVENTION

Prior Art Background

The process of extracting oil and gas typically consists of operations that include preparation, drilling, completion, production and abandonment.

Preparing a drilling site involves ensuring that it can be properly accessed and that the area where the rig and other equipment will be placed has been properly graded. Drilling pads and roads must be built and maintained which includes the spreading of stone on an impermeable liner to prevent impacts from any spills but also to allow any rain to drain properly.

In the drilling of oil and gas wells, a wellbore is formed using a drill bit that is urged downwardly at a lower end of a drill string. After drilling the wellbore is lined with a string of casing. An annular area is thus formed between the string of casing and the wellbore. A cementing operation is then conducted in order to fill the annular area with cement. The combination of cement and casing strengthens the wellbore and facilitates the isolation of certain areas of the formation behind the casing for the production of hydrocarbons.

The first step in completing a well is to create a connection between the final casing and the rock which is holding the oil and gas. There are various operations in which it may become necessary to isolate particular zones within the well. This is typically accomplished by temporarily plugging off the well casing at a given point or points with a plug.

In many instances a single wellbore may traverse multiple hydrocarbon formations that are otherwise isolated from one another within the earth. It is also frequently desired to treat such hydrocarbon bearing formations with pressurized treatment fluids prior to producing from those formations. In order to ensure that a proper treatment is performed on a desired formation, that formation is typically isolated during treatment from other formations traversed by the wellbore. To achieve sequential treatment of multiple formations, the casing adjacent to the toe of a horizontal, vertical, or deviated wellbore is first perforated while the other portions of the casing are left unperforated. The perforated zone is then treated by pumping fluid under pressure into that zone through perforations. Following treatment a plug is placed adjacent to the perforated zone. The process is repeated until all the zones are perforated. The plugs are particularly useful in accomplishing operations such as isolating perforations in one portion of a well from perforations in another portion or for isolating the bottom of a well from a wellhead. The purpose of the plug is to isolate some portion of the well from another portion of the well. Bridge plugs, frac plugs, and packers are downhole tools that are typically used to permanently or temporarily isolate one wellbore zone from another. Such isolation is often necessary to pressure test, perforate, frac, or stimulate a zone of the wellbore without impacting or communicating with other zones within the wellbore. To reopen and/or restore fluid communication through the wellbore, plugs are typically removed or otherwise compromised.

Certain completion and/or production activities may require several plugs run in series or several different plug types run in series. For example, one well may require three bridge plugs and five drop ball plugs, and another well may require two bridge plugs and ten drop ball plugs for similar completion and/or production activities. Within a given completion and/or production activity, the well may require several hundred plugs and/or packers depending on the productivity, depths, and geophysics of each well. The uncertainty in the types and numbers of plugs that might be required typically leads to the over-purchase and/or under purchase of the appropriate types and numbers of plugs resulting in fiscal inefficiencies and/or field delays.

Subsequently, production of hydrocarbons from these zones requires that the sequentially set plugs be removed from the well. In order to reestablish flow past the existing plugs an operator must remove and/or destroy the plugs by milling, drilling, or dissolving the plugs.

Exemplary prior art covering configurable frac plugs includes the following:

Pub. No. US 2012/0279700 A1 discloses an insert for a downhole plug for use in a wellbore. The insert can include a body having a bore formed at least partially therethrough. One or more threads can be disposed on an outer surface of the body and adapted to threadably engage an inner surface of the plug proximate a first end of the plug. One or more shearable threads can be disposed on an inner surface of the body. The one or more shearable threads can be adapted to threadably engage a setting tool that enters the plug through the first end thereof and to deform to release the setting tool when exposed to a predetermined force that is less than a force required to deform the one or more threads disposed on the outer surface of the body. At least one impediment can be disposed within the body.

The insert taught in Pub. No. US 2012/0279700 A1 requires one or more shear able threads that are disposed on an inner surface of the body. However, the threads may be required to keep a ball seat in place for a ball-in-place frac plug or retain a cage for a caged ball frac plug. Therefore, there is a need for a shearing mechanism during setting of the plug that does not shear at the threads disposed on an inner surface of the body, but at another shear point proximal to the threads.

Pub. No. US 2010/0263876 A1 discloses a series of down hole tools assembled from a common subassembly to which are added various specialty parts to make a flow back plug, a bridge plug or a plug with a disintegratable check valve. The subassembly may be used, as is, as a ball drop plug. The components may be added through either end of the subassembly without having to take the subassembly apart. The subassembly and specialty parts may be shipped to the customer so the end user may customize the subassembly to provide a plug operable to provide a variety of functions.

However, Pub. No. US 2010/0263876 A1 requires separate parts to be shipped and assembled in the field to configure various plugs needed in the operations. If a particular item is not available when needed considerable time and money is lost until the part is made available. There is a need for an integrated plug shipped as one piece that contains all the necessary elements to convert a bridge plug to any version of a frac plug.

Deficiencies in the Prior Art

The prior art as detailed above suffers from the following deficiencies:

Prior art systems do not provide for a single piece bridge plug that could be converted to a caged frac plug in the field of operations.

Prior art systems do not provide for a single piece bridge plug that could be converted to a ball-in-place frac plug in the field of operations.

Prior art systems do not provide for a single piece bridge plug that could be converted to a ball-drop frac plug in the field of operations.

Prior art systems do not provide for shearing a bridge plug at a thin portion other than the threads of the bridge plug made from a composite material.

Prior art systems do not provide for the use of a lower restriction element so that a low strength material may be used for the body of a bridge plug or a frac plug.

Prior art systems do not provide for a single shipping package solution that enables conversion of a bridge plug to a caged frac plug, ball-in-place frac plug and a ball-in-place frac plug in the field of operations.

While some of the prior art may teach some solutions to several of these problems, the core issue of shipping a single piece bridge plug that could be easily converted into one of frac plug variants in the field of operation has not been addressed by prior art.

OBJECTIVES OF THE INVENTION

Accordingly, the objectives of the present invention are (among others) to circumvent the deficiencies in the prior art and affect the following objectives:

Provide for a single piece bridge plug that could be converted to a caged frac plug in the field of operations.

Provide for a single piece bridge plug that could be converted to a ball-in-place frac plug in the field of operations.

Provide for a single piece bridge plug that could be converted to a ball-drop frac plug in the field of operations.

Provide for shearing a bridge plug at a thin portion other than the threads of the bridge plug.

Provide for the use of a lower restriction element so that a low strength material may be used for the body of a bridge plug or a frac plug.

Provide for a single shipping package solution that enables conversion of a bridge plug to a caged frac plug, ball-in-place frac plug and a ball-in-place frac plug in the field of operations While these objectives should not be understood to limit the teachings of the present invention, in general these objectives are achieved in part or in whole by the disclosed invention that is discussed in the following sections. One skilled in the art will no doubt be able to select aspects of the present invention as disclosed to affect any combination of the objectives described above.

BRIEF SUMMARY OF THE INVENTION

Apparatus Overview

The present invention in various embodiments addresses one or more of the above objectives in the following manner. An embodiment of the present invention provides a configurable composite bridge plug apparatus and method for converting bridge plugs into frac plugs in the field of operation is disclosed. The bridge plug apparatus includes a body that comprises a cylindrical hollow inner mandrel, an upper threaded end and a lower threaded end. A release ring with threads disposed on an outer surface is attached to the upper inside threaded end. An upper restriction element and a lower restriction element plug attached to both ends of the hollow inner mandrel so that flow is restricted in either directions. A stand-off pin retains the lower restriction element in place. A ball seat inserted proximally to the upper restriction element towards the upper threaded end. A cage retainer is attached to the ball seat with a ball. The configurable bridge plug is transformed to a frac plug by removing the upper restriction element and the lower restriction element from the bridge plug.

Method Overview

The present invention system may be utilized in the context of an overall gas extraction method, wherein the composite configurable bridge plug described previously is converted to a caged frac plug by a method having the following steps:

(1) shipping the bridge plug to a job location as one piece;
(2) removing the lower restriction element;
(3) removing the release ring;
(4) removing the cage retainer, the ball and the ball seat;
(5) removing the upper restriction element; and
(6) re-installing the ball seat, the ball, the cage retainer and the release ring without the upper restriction element.

Integration of this and other preferred exemplary embodiment methods in conjunction with a variety of preferred exemplary embodiment systems described herein in anticipation by the overall scope of the present invention.

BRIEF DESCRIPTION OF THE DRAWINGS

For a fuller understanding of the advantages provided by the invention, reference should be made to the following detailed description together with the accompanying drawings wherein.

DESCRIPTION OF THE PRESENTLY PREFERRED EXEMPLARY EMBODIMENTS

Figure 1:
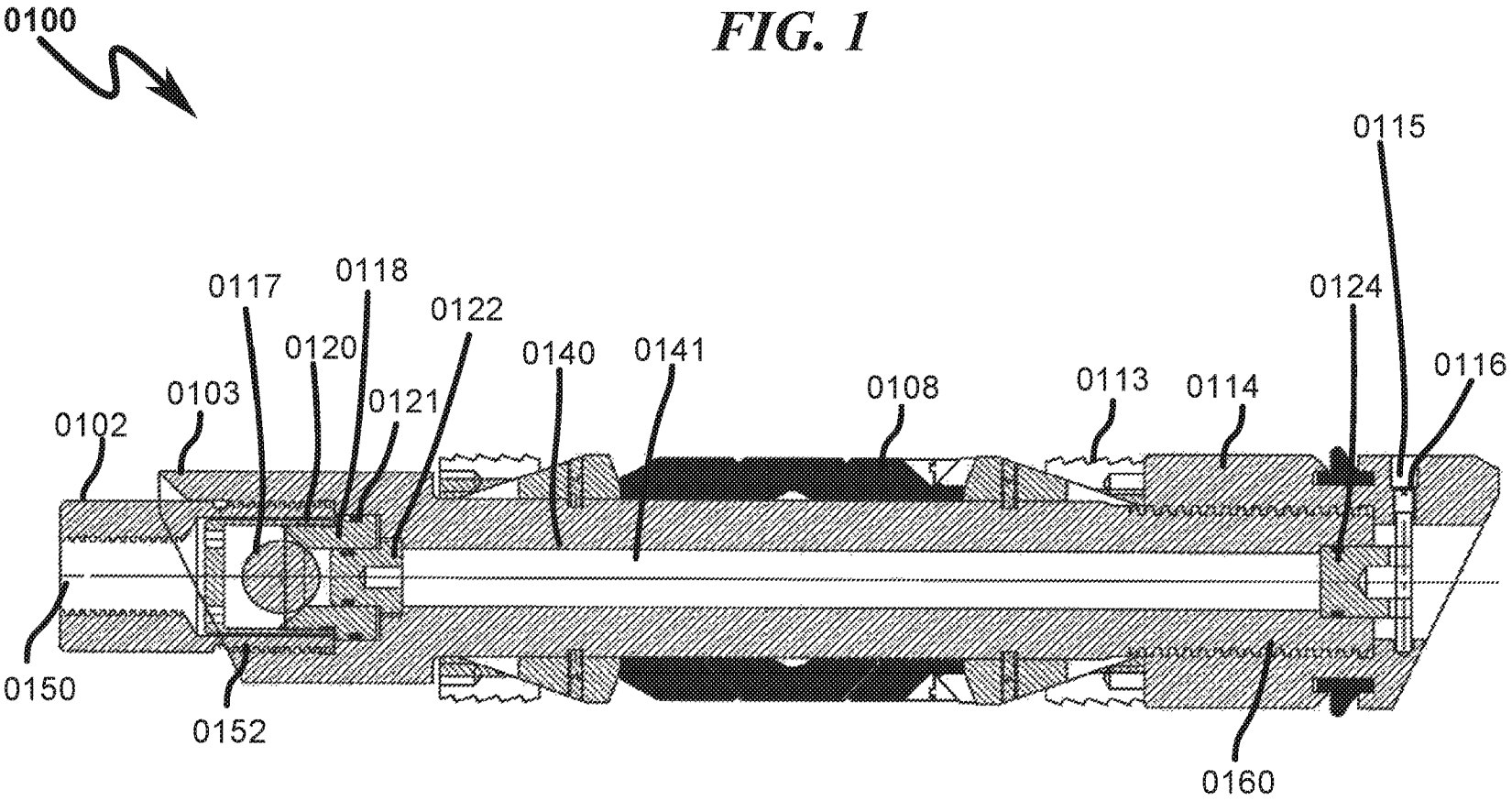
FIG. 1 illustrates an exemplary cross section view of a configurable bridge plug depicting a preferred embodiment of the present invention.

While this invention is susceptible of embodiment in many different forms, there is shown in the drawings and will herein be described in detailed preferred embodiment of the invention with the understanding that the present disclosure is to be considered as an exemplification of the principles of the invention and is not intended to limit the broad aspect of the invention to the embodiment illustrated.

The numerous innovative teachings of the present application will be described with particular reference to the presently preferred embodiment, wherein these innovative teachings are advantageously applied to the particular problems of a configurable composite bridge plug apparatus and method. However, it should be understood that this embodiment is only one example of the many advantageous uses of the innovative teachings herein. In general, statements made in the specification of the present application do not necessarily limit any of the various claimed inventions. Moreover, some statements may apply to some inventive features but not to others.

The words upper and lower are somewhat inaccurate because they refer to the position of the well tools as if they were in a vertical position while many, if not most, of the plugs disclosed herein will be used primarily in horizontal wells. The words upper and lower are used for purposes of convenience rather than the more accurate proximal and distal. The terms "upper" or "upstream" as used herein is a direction towards a heel end of a horizontal or deviated wellbore. The term "lower" or "downstream" as used herein is a direction towards a toe end of a horizontal or deviated wellbore.

It should be noted that the term "bridge plug" as used herein describes a plug that prevents flow, in either direction (upstream and downstream directions). It should be noted that the term "frac plug" as used herein describes a plug that prevents flow, in at least one direction, either upstream or downstream. It should be noted that the term "caged frac plug" as used herein describes a frac plug that comprises a cage to retain a ball that flows back in a limited space in the cage. It should be noted that the term "ball-in-place frac plug" as used herein describes a frac plug that comprises a ball in a ball seat that freely flows back in an upstream direction. It should be noted that the term "ball-drop frac plug" as used herein describes a frac plug that ball seat configured to accept a ball dropped from the surface during isolation operations. The terms "bridge plug", "configurable bridge plug", "composite bridge plug", and "composite configurable bridge plug" are used interchangeably to describe a bridge plug that may be converted to one of the frac plug variants in the field of operations.

Exemplary Composite Bridge Plug Embodiment (0100)

An exemplary composite bridge plug is generally illustrated in FIG. 1 (0100). The plug (0100) in some embodiments may comprise a hollow inner mandrel (0140), an upper threaded end (0150) and a lower threaded end (0160). The upper threaded end (0150) configured with inner threads (0152) disposed on an inner surface of the body (0103). The plug may further comprise a release ring configured with outer threads disposed on an outer surface of the release ring. The outer threads of the release ring may be threaded into the inner threads (0152) of the body (0103). A upper restriction element (0122) such as a plug may be used to cap an upper end (upstream end) of the hollow inner mandrel (0140) and a lower restriction element (0124) may be used to cap a lower end (downstream end) of the hollow inner mandrel (0140). In some embodiments, the upper end and lower end of the mandrel may include one or more O-rings (0121) or other seals engaging the upper restriction element (0122) and lower restriction element (0124) to the inside of the mandrel (0140). A stand-off pin (0116) may be used to restrain the lower restriction element (0124) in place, a ball seat (0118) may be positioned in a cavity in the upper threaded end (0150) proximal to the upper restriction element (0122) and a cage retainer (0120) may be mechanically coupled to the ball seat (0118) that is shaped to accept and seat a ball (0117).

Figure 2:
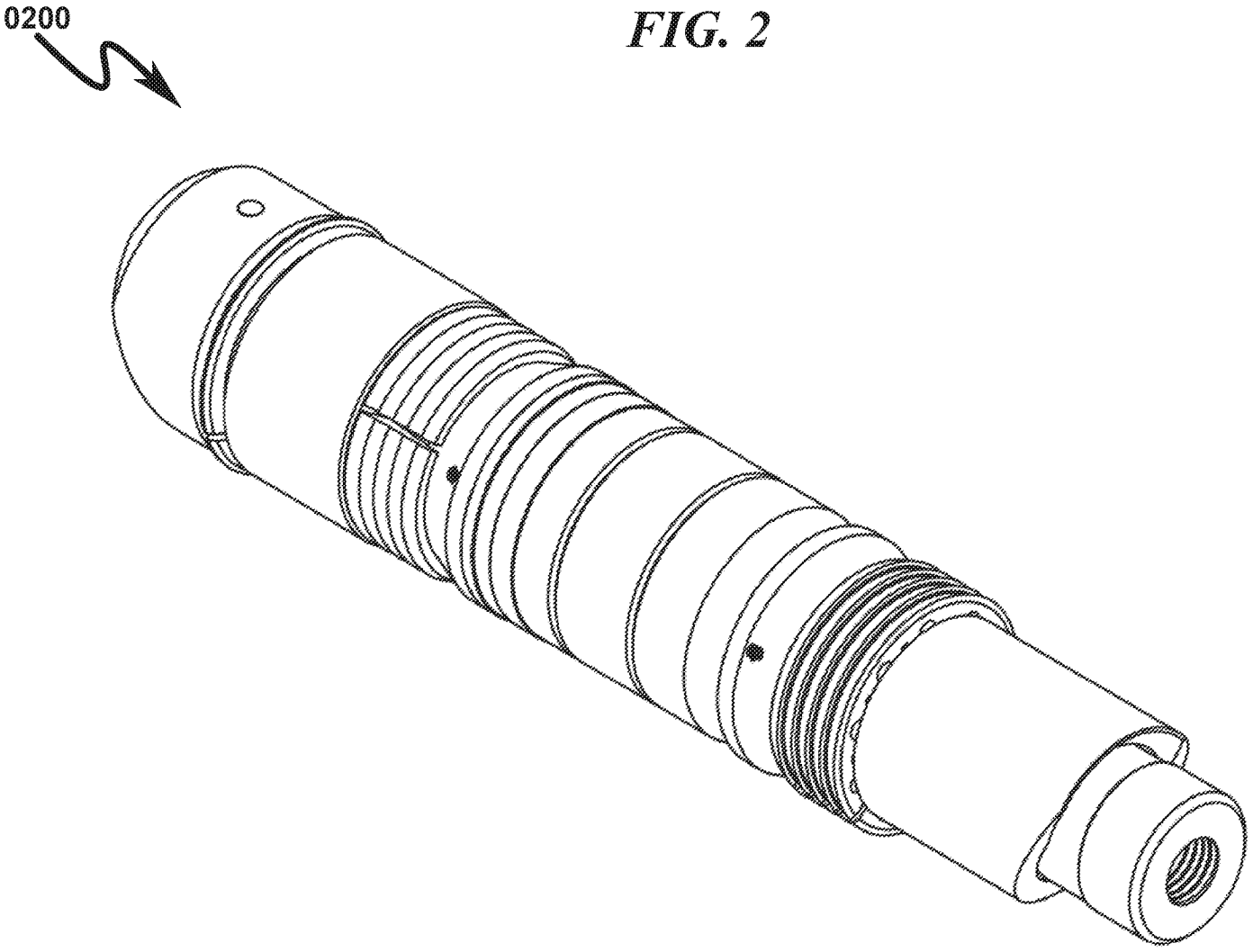
FIG. 2 illustrates an exemplary perspective view of a configurable bridge plug depicting a preferred embodiment of the present invention.

According to a preferred exemplary embodiment, the bridge plug and the components of the bridge plug may be selected from a group comprising composite plastics, composite fiber, G10, aluminum, bronze, cast iron or other drillable materials. Composite plastics are well known in the art and are of a variety of types, such as a fabric impregnated with a suitable resin and allowed to cure, a wound fiberglass filament resin impregnated material, a fiber molded injection impregnated material or the like. According to another preferred exemplary embodiment, composite body material is constructed of FR-4 phenolic glass base laminate layers impregnated with synthetic thermosetting resins. This material offers high tensile strength along with high material collapse strength and is ideal for use in high pressure frac plug variants. However, since the material is laminated, burst strength (rupture from inside to outside) is poor. For this reason, the lower restriction element (0124) will prohibit a higher differential pressure existing below the set bridge plug (0100) assembly from entering into the central hole/passage (0141) inside the body (0103) and exerting a burst force (pushing outward) on the laminate centerline layers causing the body to split (delaminate). According to a preferred exemplary embodiment, the lower restriction element (0124) enables use of a laminated material for the composite body (0103) such that the body is not exposed to higher differential pressure existing below (downstream) the set bridge plug from entering into the central hole inside the body and exerting a burst force. For example, the lower restriction element (0124) may enable the use of a lower strength material such as G10 for the composite body (0103). A perspective view of the composite bridge plug shown in FIG. 1 is generally illustrated in FIG. 2.

Exemplary Release Ring (0300-0400) Embodiment

Figure 3:
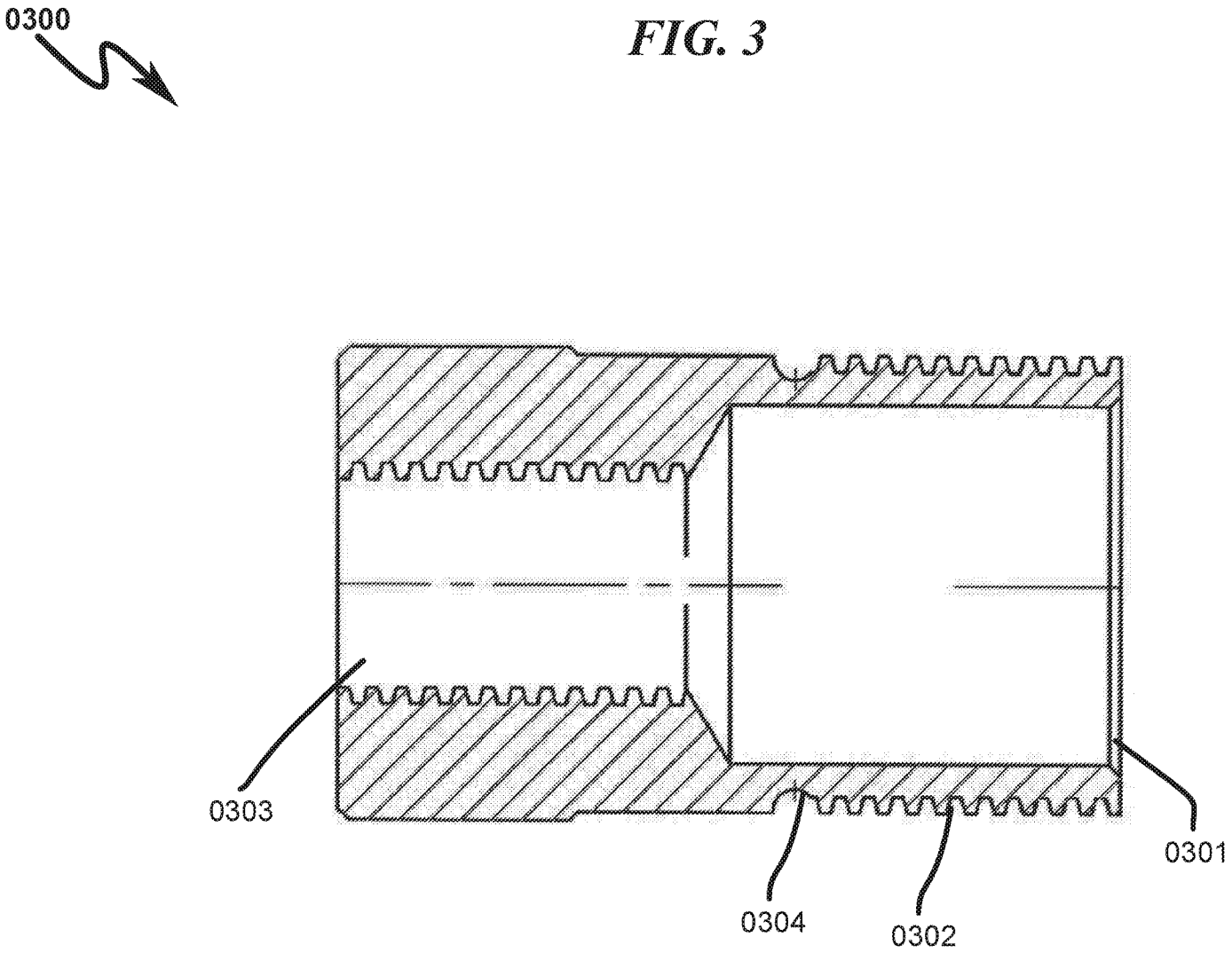
FIG. 3 illustrates a cross section view of an exemplary release ring in a configurable bridge plug depicting a preferred embodiment of the present invention.
Figure 4:
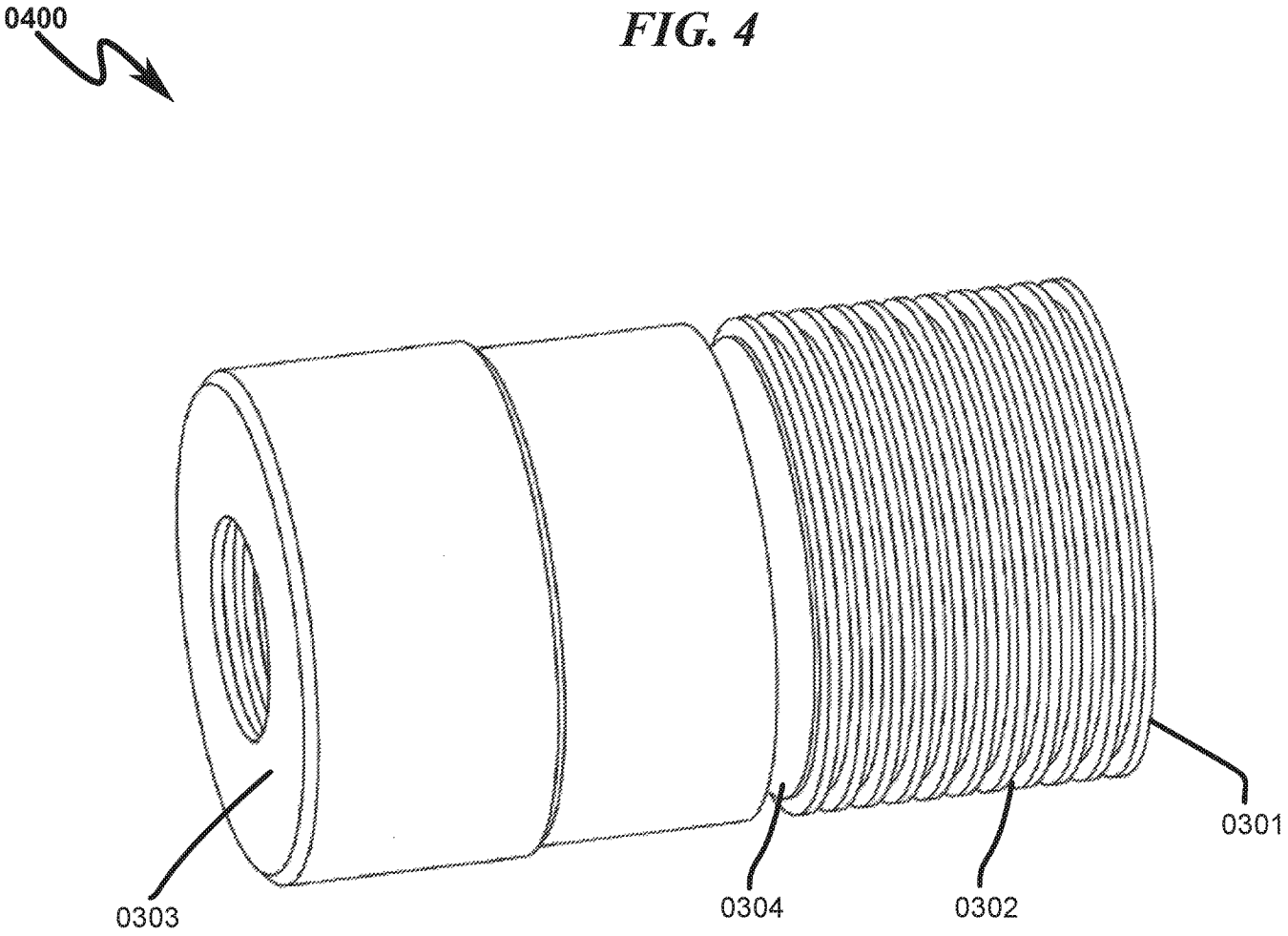
FIG. 4 illustrates a perspective view of an exemplary release ring in a configurable bridge plug depicting a preferred embodiment of the present invention.

As generally illustrated in FIG. 3 (0300), a detailed cross section view of a release ring may comprise an upper hollow threaded section (0303) attached to a lower hollow threaded section (0301). Inner threads (0302) disposed on the inside surface of the upper hollow threaded section (0303) may be provided for coupling with outer threads of a setting tool. A wellbore setting tool may set a bridge plug and release the bridge plug in place after setting. The setting tool may use a certain force required to push on the slips that are disposed on the outside of the bridge plug and pull on the release ring to expand the slips and set the bridge plug against an inner surface of a wellbore casing. Similarly, the setting tool may further pull on the release ring and push on the slips with a greater force so that the release ring shears at a weak point in the lower threaded section (0301). The wellbore setting tool may comprise an extended section with outer threads that thread into the inner threads (0302) of the upper threaded section of the release ring. The number of threads and the length of the upper threaded section may be selected to withstand the force of setting a composite bridge plug with a wellbore setting tool. Similarly, the number of threads and the length of the lower threaded section may be selected so as to withstand the force of setting and a force of removal of the wellbore setting tool while leaving the bridge plug and lower threaded section (0301) of the release ring with the bridge plug. The lower threaded section of the release ring may comprise a thin section (0304) that is designed to shear during removal of a wellbore setting tool without shearing at the threaded portion of the release ring. It should be noted that prior art setting tools and plugs are designed to shear at a threaded portion of a plug. According to a preferred exemplary embodiment a thin section in a release ring is specifically designed for shearing during removal process. According to a preferred exemplary embodiment, the thickness of the thin section may range from 0.01 in. to 1 in. According to a more preferred exemplary embodiment, the thickness of the thin section may range from 0.03 in. to 0.8 in. According to a most preferred exemplary embodiment, the thickness of the thin section may range from 0.05 in. to 0.2 in. The thin section may form a groove, an indentation or a channel. According to a preferred exemplary embodiment, when a configurable composite bridge plug is set by a setting tool in a wellbore casing, the release ring shears at a groove in the thin section during removal of said setting tool. According to further exemplary embodiment, outer threads in the lower threaded section (0301) retain a cage retainer and a ball seat that are disposed in a hollow section at the upper end of a bridge plug. FIG. 4 (0400) generally illustrates a perspective view of the release ring illustrated in FIG. 3 (0300).

Exemplary Ball Seat in a Configurable Bridge Plug Embodiment (0500)

Figure 5B:
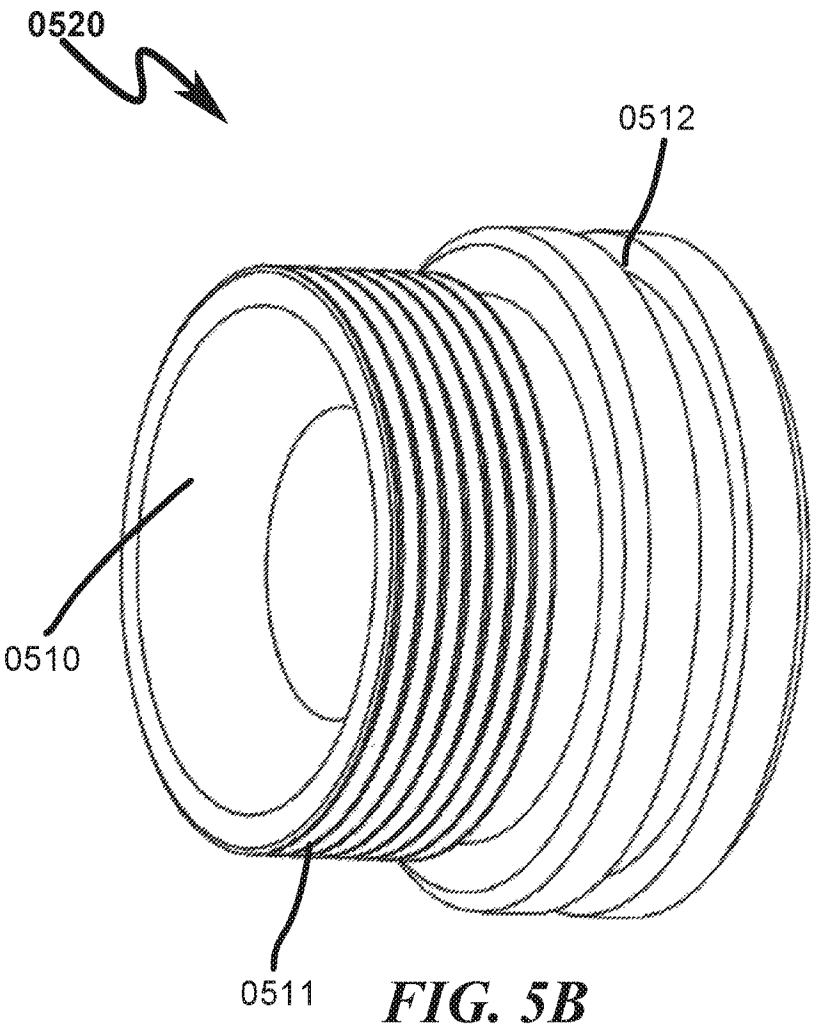
FIG. 5A and FIG. 5B illustrate a cross section view and a perspective view of an exemplary frac ball seat in a configurable bridge plug depicting a preferred embodiment of the present invention.
Figure 5A:
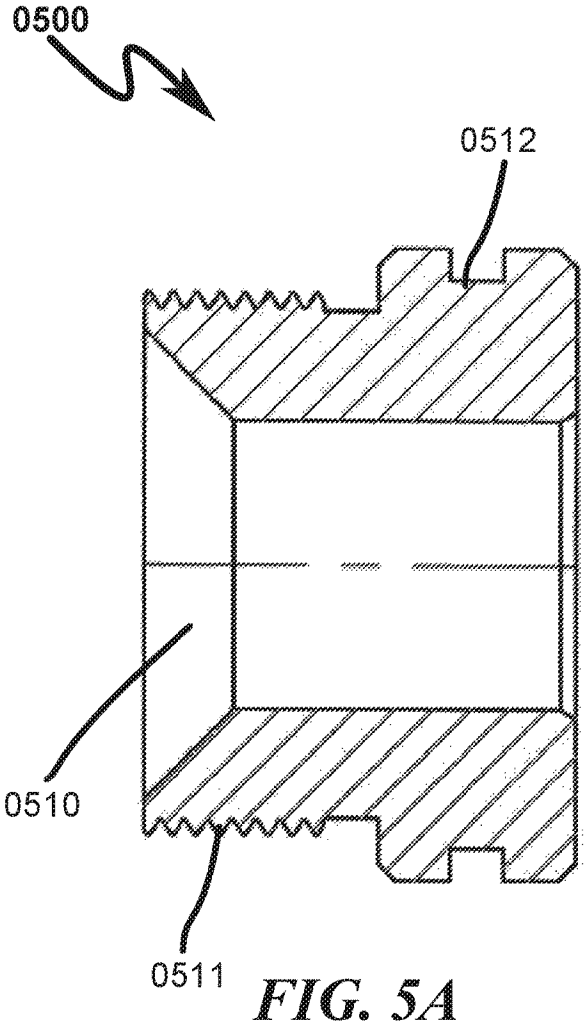

As generally illustrated in FIG. 5A (0500), an exemplary ball seat (0510) may be designed to be slipped into an upper end of an inner mandrel of an exemplary configurable bridge plug. For example, as generally shown in FIG. 1 (0100), the ball seat (0118) may be attached at an upper end of hollow mandrel (0140). The ball seat may provide a conforming surface to seat a ball or any restriction plug element. The ball seat may further comprise threads (0511) disposed on the outer surface of the ball seat for coupling with threads of upper end of a configurable bridge plug. A groove (0512) may be provided to lock the ball seat in place. A perspective view of the ball seat is generally illustrated in FIG. 5B (0520). The ball seat may be attached to a cage retainer for a ball-in-place frac plug variant. O-rings and seals may be used to further lock the ball seat in place. The ball seat may be directly coupled to the body of a bridge plug for a ball-drop frac plug variant. The ball seat may be made from materials that are easily drillable such as cast iron, steel or reinforced plastic.

Exemplary Cage Retainer in a Configurable Bridge Plug Embodiment (0600)

Figure 6A:
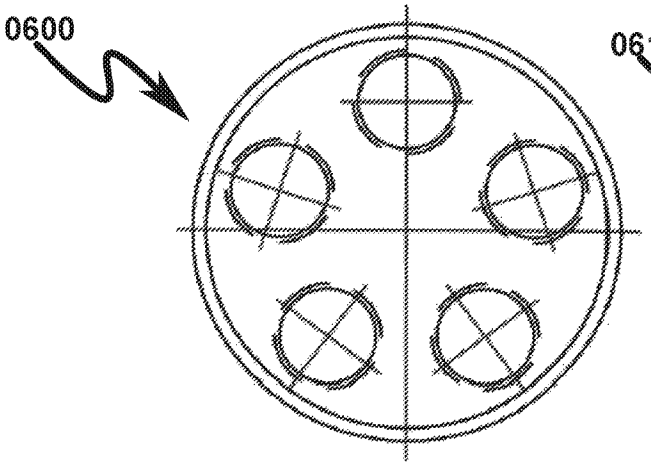
FIG. 6A, FIG. 6B and FIG. 6C illustrate an end view, a cross section view and a perspective view of an exemplary cage retainer in a configurable bridge plug depicting a preferred embodiment of the present invention.
Figure 6B:
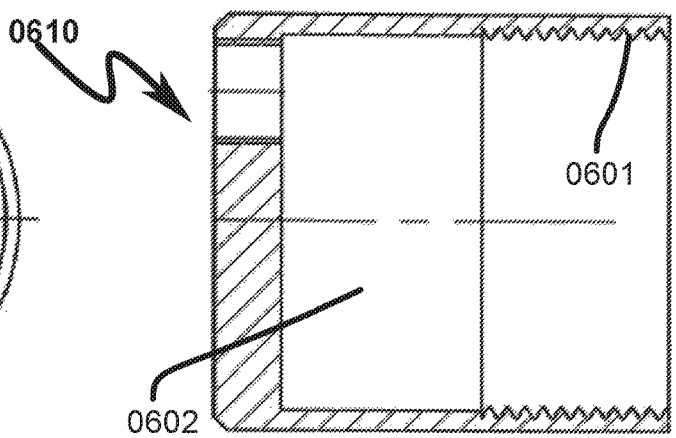
Figure 6C:
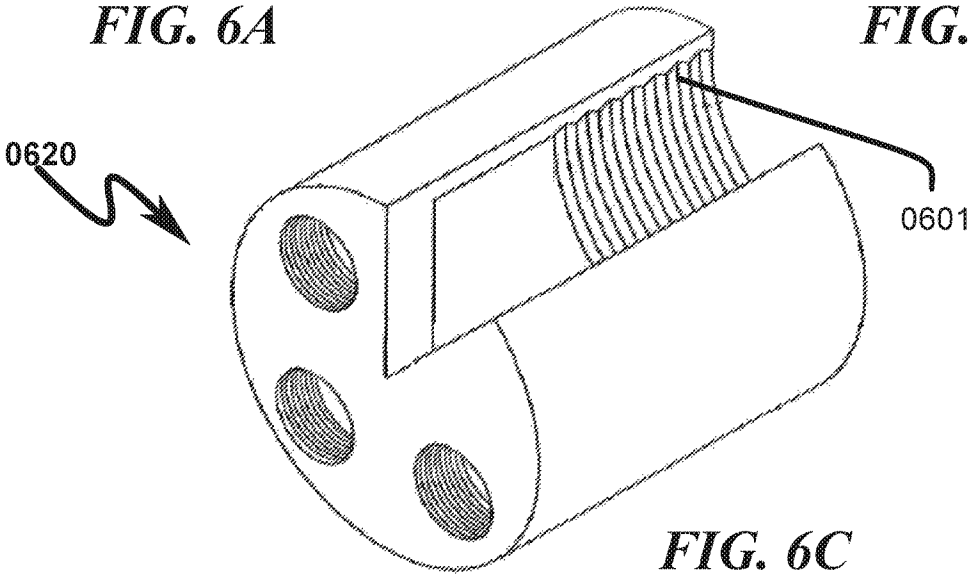

As generally illustrated in FIG. 6B (0610), an exemplary cage retainer may be designed to be screwed or threaded into an upper end of an inner mandrel of an exemplary configurable bridge plug. For example, as generally shown in FIG. 1 (0100), the cage retainer (0120) may be attached or coupled at an upper end of hollow mandrel (0140). The cage retainer may be coupled or threaded to a ball seat with threads (0601) disposed on the inside surface of the retainer (0600). The cage retainer may also be attached to the configurable bridge plug directly if a ball seat is absent. A hollow space (0602) in the cage retainer (0600) enables a ball seated in a ball seat to have a limited movement. The volume of space may be designed such that there is enough flow around a ball in at least one direction. For example, a fluid pumped from the surface may bypass the ball seated in a ball seat in the downstream direction without substantially obstructing the flow. The cage retainer may be made from materials that are easily drillable such as cast iron, steel or reinforced plastic. A perspective view of the cage retainer is generally illustrated in FIG. 6C (0620). An end view of the cage retainer is generally illustrated in FIG. 6A (0600). The ball seat may be attached to the cage retainer for a ball-in-place frac plug variant. According to a preferred exemplary embodiment, the ball seat and the cage retainer remain in place in the bridge plug during and after a setting tool is removed from the bridge plug.

Exemplary Upper Restriction Element in a Configurable Bridge Plug Embodiment (0700)

Figure 7B:
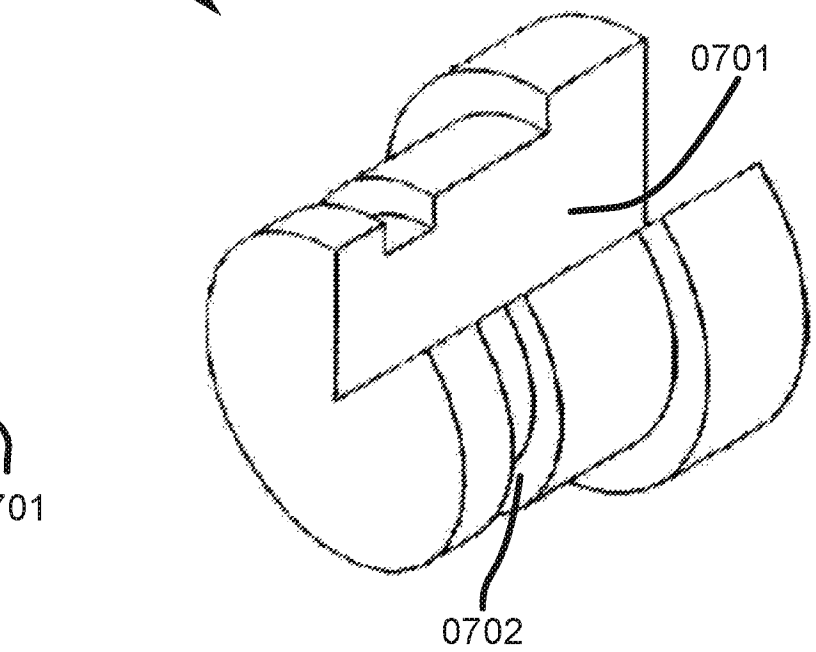
FIG. 7A and FIG. 7B illustrate a cross section view and a perspective view of an exemplary upper restriction element in a configurable bridge plug depicting a preferred embodiment of the present invention.
Figure 7A:
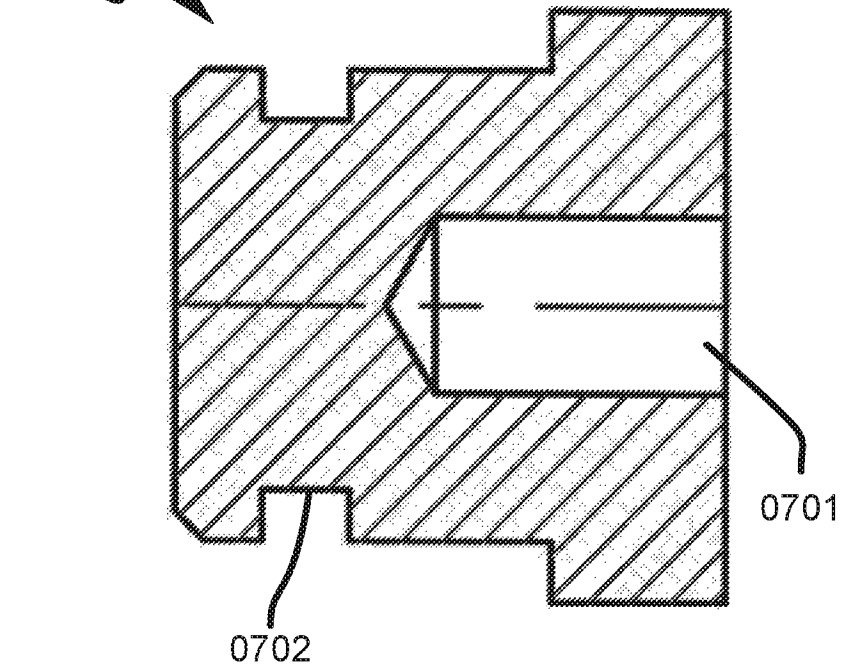

As generally illustrated in FIG. 7 (0710), an exemplary upper restriction element may be designed to cap an upper end of an inner mandrel of an exemplary configurable bridge plug. For example, as generally illustrated in FIG. 1 (0100), the upper restriction element (0122) may be attached or coupled at an upper end of hollow mandrel (0140). As generally illustrated in FIG. 1 (0100), the upper restriction element (0122) may be positioned between a ball seat (0118) and an upper end of a mandrel in a configurable bridge plug. The upper restriction element (0710) plugs or caps the upper end of a mandrel in a configurable bridge plug so that flow is restricted in at least one direction (upstream or downstream). The upper restriction element (0710) may further comprise a notch or a groove that is shaped to fit at the upper end of a mandrel. As illustrated in FIG. 7 (0710), a hollow space (0701) and a groove (0702) may be shaped such that the plug remains in place. One skilled in the art may design the shape of the hollow space and the groove such that there is no substantial movement of the upper restriction element (0710) during and after setting of the bridge plug. The upper restriction element may be removed from a configurable bridge plug to convert the bridge plug into a ball-in-place frac plug, ball-drop frac plug or a caged frac plug. The upper restriction element remains in the bridge plug for a bridge plug functionality so that flow is restricted in upstream and downstream directions. A perspective view of the upper restriction element is generally illustrated in FIG. 7 (0720). According to a preferred exemplary embodiment, the upper restriction element may be made from a material selected from a group comprising: steel, cast iron, aluminum, plastic or G10.

Exemplary Lower Restriction Element in a Configurable Bridge Plug Embodiment (0800)

Figure 8B:
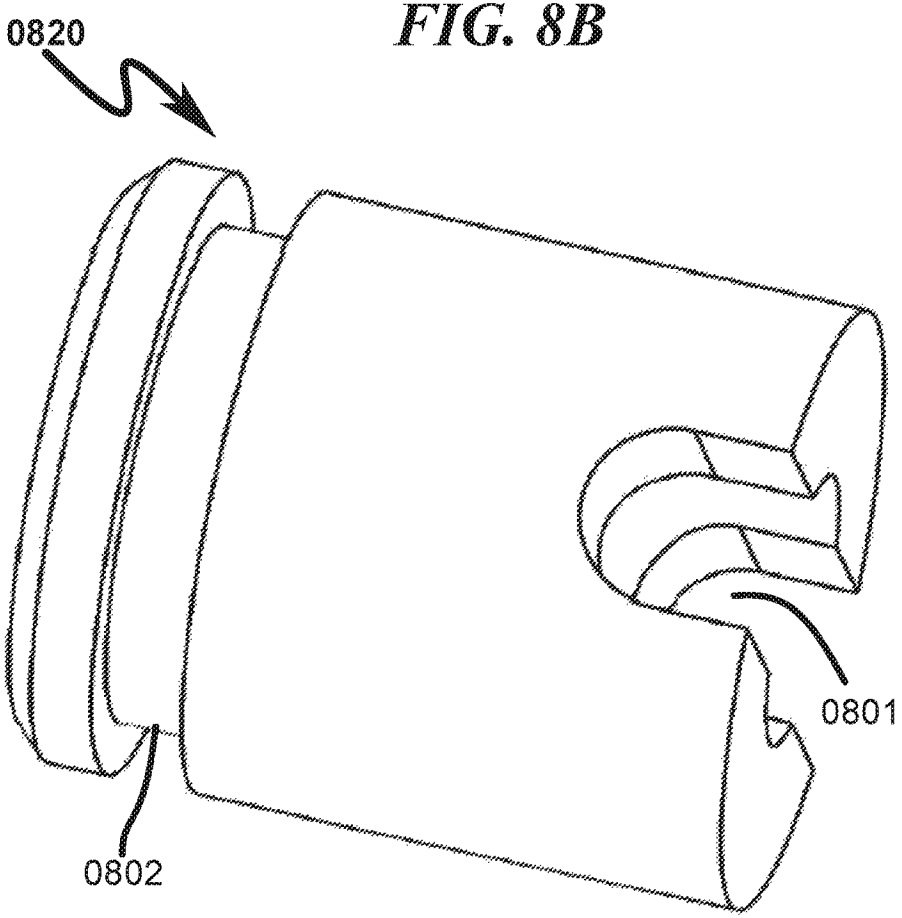
FIG. 8A and FIG. 8B illustrate a cross section view and a perspective view of an exemplary lower restriction element in a configurable bridge plug depicting a preferred embodiment of the present invention.
Figure 8A:
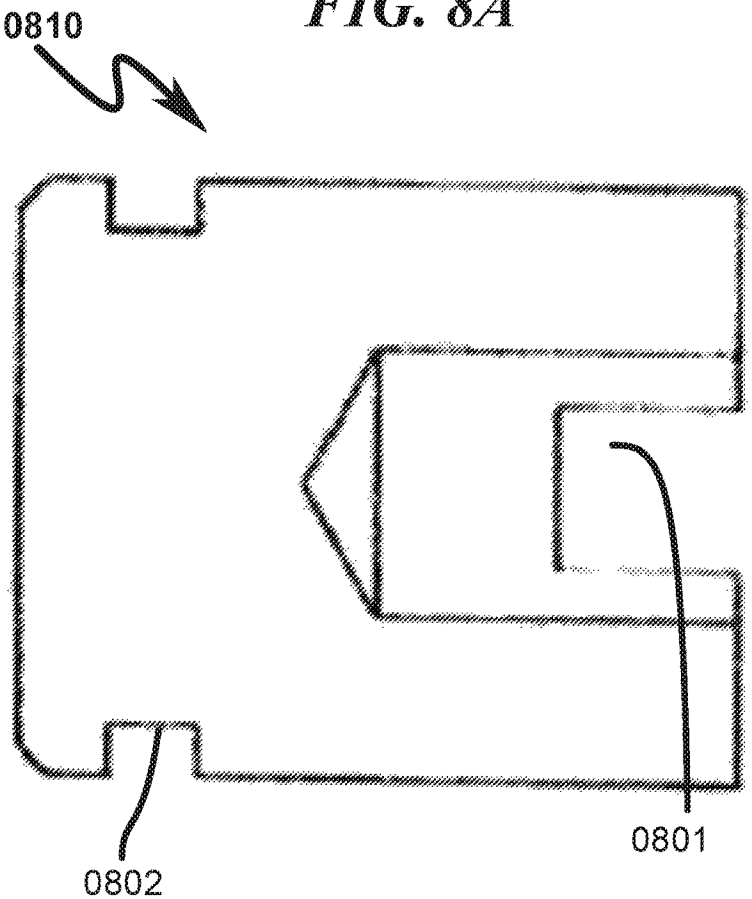

As generally illustrated in FIG. 8 (0810), an exemplary lower restriction element may be designed to cap an upper end of an inner mandrel of an exemplary configurable bridge plug. For example, as generally illustrated in FIG. 1 (0100), the lower restriction element (0124) may be attached or coupled at a lower end (downstream end) of a hollow mandrel (0140). As generally illustrated in FIG. 1 (0100), the lower restriction element (0124) may be held in place by a stand-off pin (0116). The lower restriction element (0810) plugs or caps the lower end of a mandrel in a configurable bridge plug so that flow is restricted in at least one direction (upstream or downstream). The lower restriction element (0810) may further comprise a notch or a groove that is shaped to fit at the lower end of a mandrel. As illustrated in FIG. 8 (0810), a hollow space (0801) and a grove (0802) may be shaped such that the plug remains in place. One skilled in the art may design the shape of the hollow space and the groove such that there is no substantial movement of the lower restriction element (0810) during and after setting of a bridge plug. The lower restriction element may be removed from a configurable bridge plug to convert the bridge plug into a ball-in-place frac plug, ball-drop frac plug or a caged frac plug. The lower restriction element remains in the bridge plug for a bridge plug functionality so that flow is restricted in upstream and downstream directions. A perspective view of the lower restriction element is generally illustrated in FIG. 8 (0820). According to a preferred exemplary embodiment, the lower restriction element may be made from a material selected from a group comprising: steel, cast iron, or aluminum.

According to a preferred exemplary embodiment, the lower restriction element (0720) enables use of a laminated material for a composite body in a configurable bridge plug such that the body is not exposed to higher differential pressure existing below (downstream) the set bridge plug from entering into the central hole inside the body and exerting a burst force. For example, the lower restriction element (0720) may enable the use of a lower strength material such as G10 for the composite body.

Exemplary Bridge Plug to Caged Frac Plug Conversion Flowchart Embodiment (0900)

Figure 9:
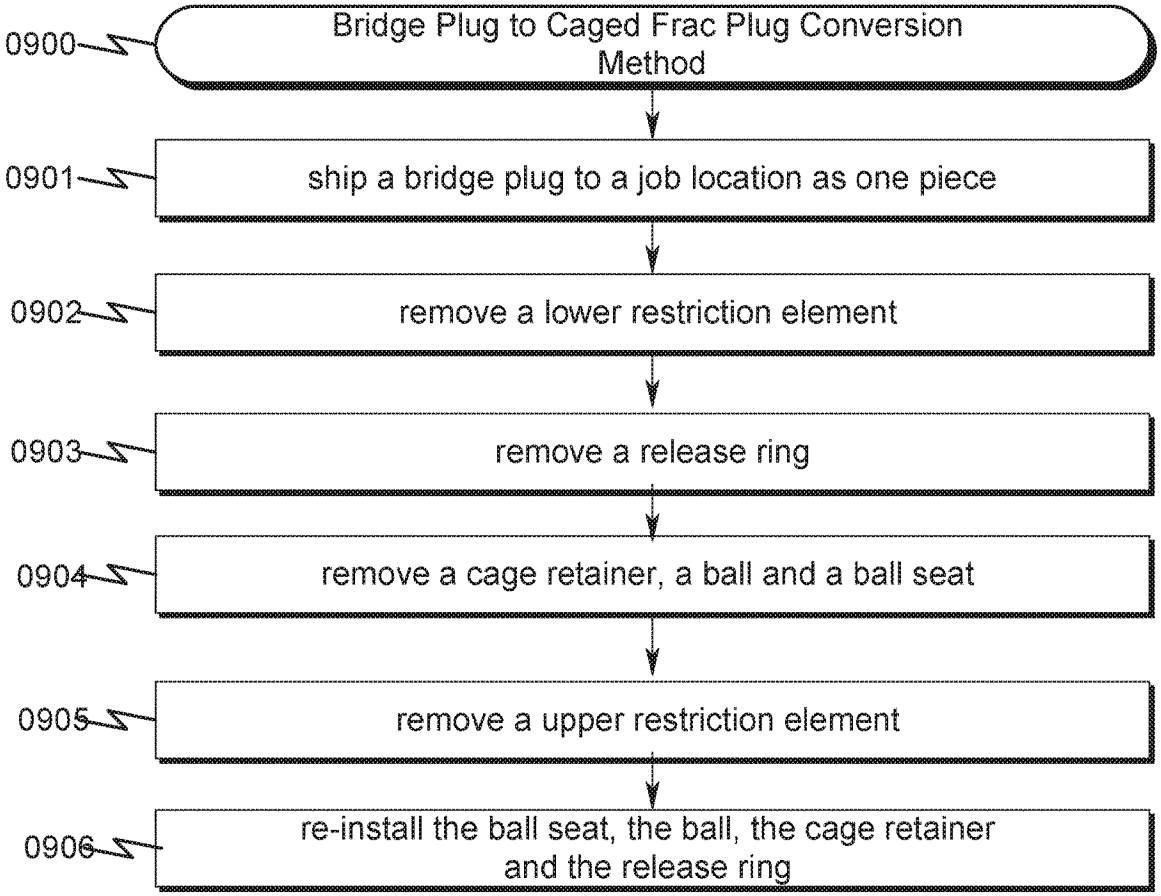
FIG. 9 illustrates a detailed flowchart of a preferred exemplary bridge plug to caged ball frac plug conversion used in some preferred exemplary invention embodiments.

A composite configurable bridge plug as illustrated in FIG. 1 (0100) may be converted into a caged frac plug. As generally seen in the flow chart of FIG. 9 (0900), a preferred exemplary bridge plug to a caged frac plug conversion method may be generally described in terms of the following steps:

(1) shipping a bridge plug to a job location as one piece (0901);

Prior art such as Pub. No. US 2010/0263876 A1 requires separate parts to be shipped and assembled in the field to configure various plugs needed in the operations. If a particular item is not available when needed considerable time and money is lost until the part is made available. In step (0901), the bridge plug such as the plug illustrated in FIG. 1 (0100) is shipped as a single piece so that there is no need for waiting on parts or waiting for missing parts to be assembled.

(2) removing a lower restriction element (0902);

Referring to FIG. 1 (0100), a lower restriction element (0124) may be removed by removing the stand-off pin (0116) and any screws (0115) holding the stand-off pin (0116). The stand-off pin may be re-inserted if there is a need. The stand-off pin must be inserted if the plug is a frac plug.

(3) removing a release ring (0903);

Referring to FIG. 1 (0100), a release ring (0102) may be unscrewed or other removal means from the body (0103) of the bridge plug.

(4) removing a cage retainer, a ball and a ball seat (0904);

Referring to FIG. 1 (0100), a cage retainer (0120) may be removed from the body (0103) of the bridge plug, followed by removing a ball (0117) and removing a ball seat (0118) from the upper end of the mandrel.

(5) removing an upper restriction element (0905); and

Referring to FIG. 1 (0100), an upper restriction element (0122) may be removed by unscrewing or other removal means.

(6) re-installing the ball seat, the ball, the cage retainer and the release ring less the upper restriction element (0122) (0906).

Referring to FIG. 1 (0100), the ball seat (0118), the ball (0117), the cage retainer (0120) and the release ring (0102) may be reinstalled in that order so that the bridge plug is converted to a caged frac plug that enables fluid communication in at least one direction either upstream or downstream or both.

Exemplary Converted Caged Frac Plug Embodiment (1000-1100)

Figure 10:
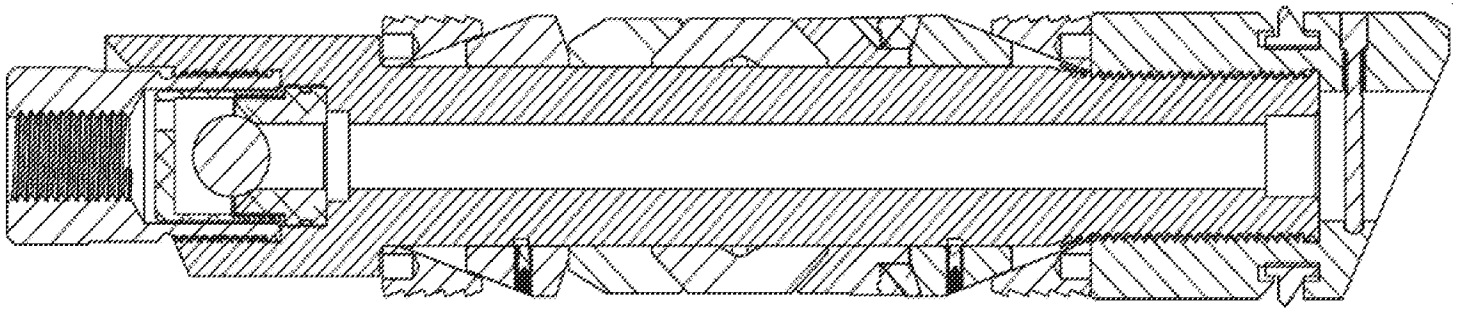
FIG. 10 illustrates an exemplary cross section view of a caged ball frac plug converted from a configurable bridge plug depicting a preferred embodiment of the present invention.
Figure 11:
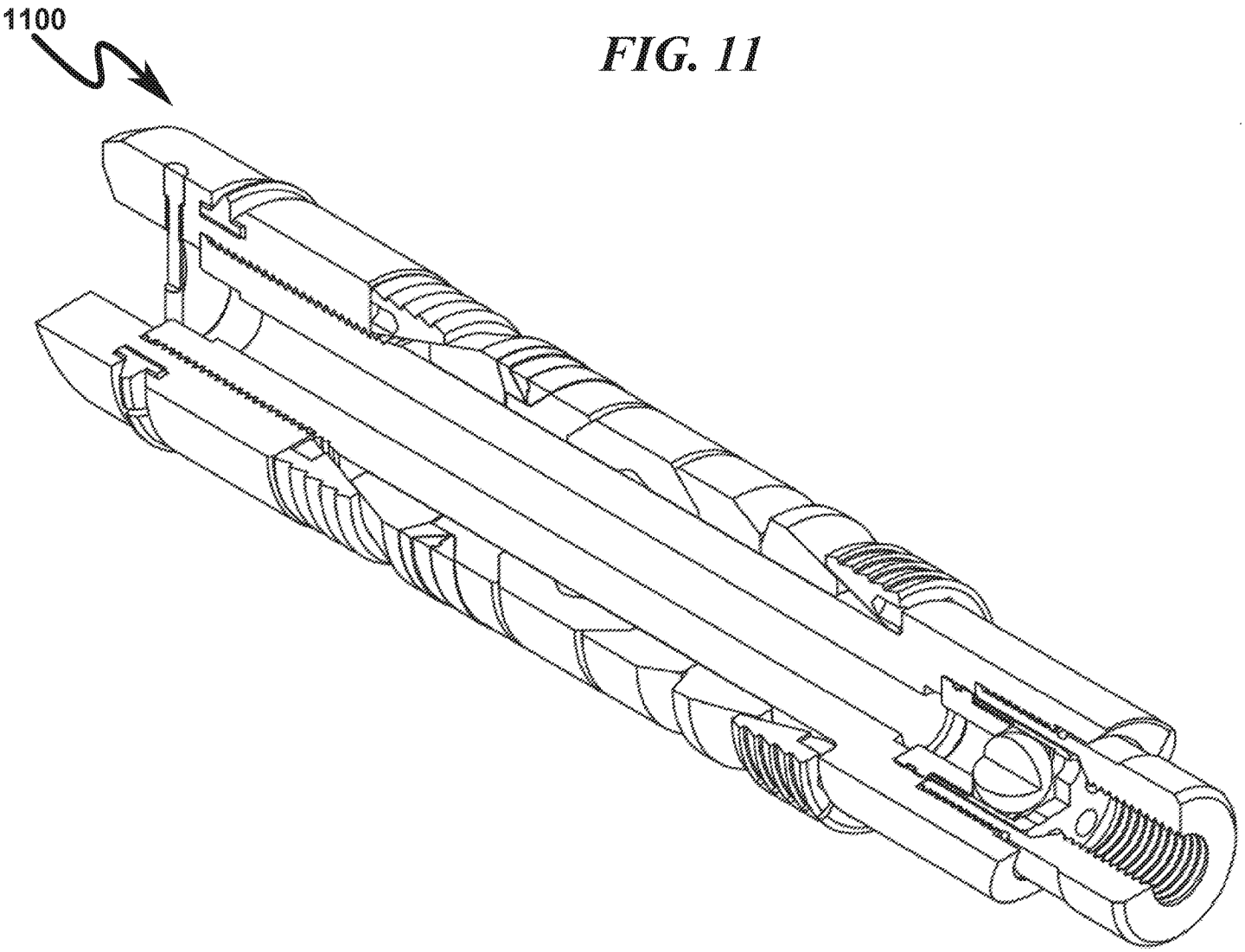
FIG. 11 illustrates an exemplary quarter section perspective view of a caged ball frac plug converted from a configurable bridge plug depicting a preferred embodiment of the present invention.

The bridge plug as illustrated in FIG. 1 (0100) may be converted into a caged frac plug by removing the upper restriction element and the lower restriction element. A converted caged frac plug is generally illustrated in FIG. 10 (1000). According to a preferred exemplary embodiment, the bridge plug may be shipped to the field or operations or an assembly shop as one single piece. A first advantage of shipping as one piece is not waiting for multiple sub-assemblies. Another advantage is the ease of conversion in the field. The conversion process may include removing a stand-off pin followed by removing the lower restriction element. Likewise, the upper restriction element may be removed by removing the release ring, a cage retainer, ball and ball seat in that order. After removal of the upper restriction element, release ring, a cage retainer, ball and ball seat may be reinstalled. The converted caged plug may be used as frac plug that enables fluid communication in at least one direction. A quarter section perspective view of the converted caged frac plug is generally illustrated in FIG. 11 (1100).

Exemplary Bridge Plug to Ball-in-Place Frac Plug Conversion Flowchart Embodiment (1200)

Figure 12:
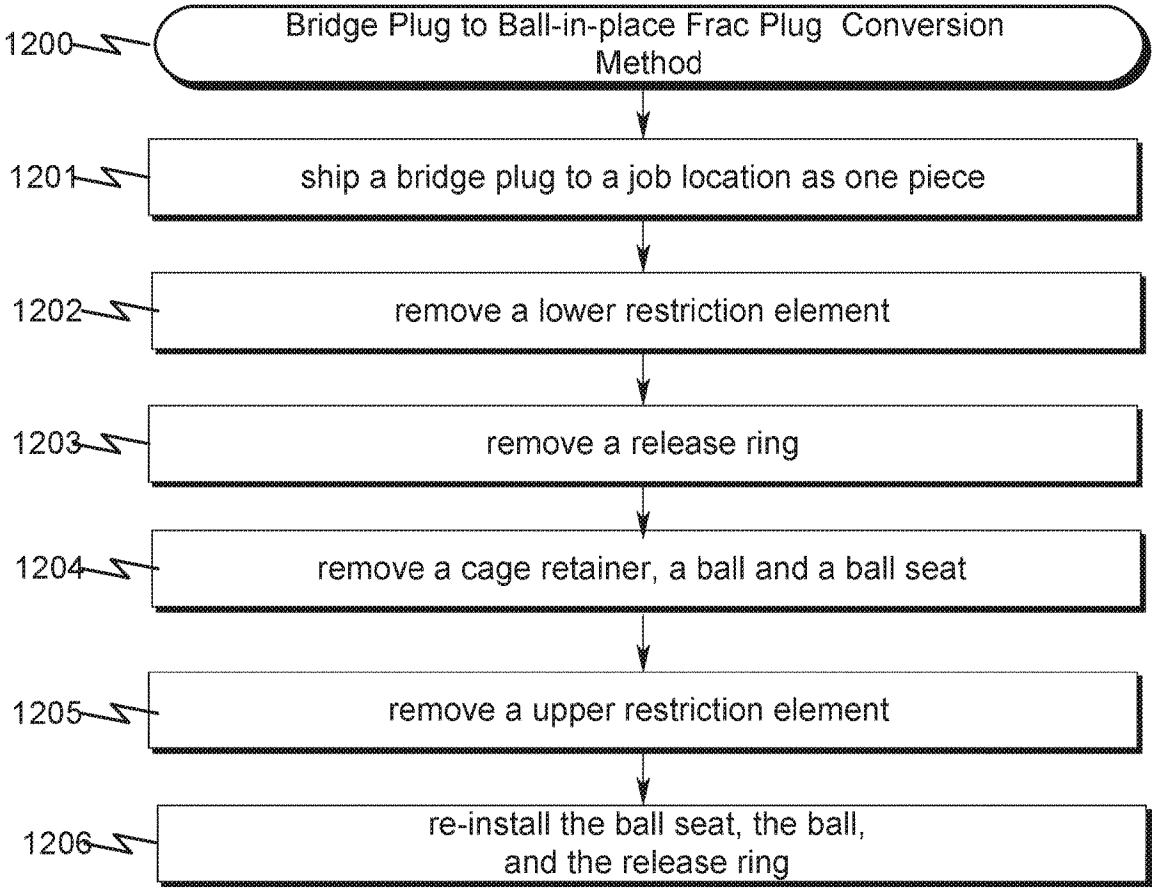
FIG. 12 illustrates a detailed flowchart of a preferred exemplary bridge plug to ball-in-place frac plug conversion used in some preferred exemplary invention embodiments.

A composite configurable bridge plug as illustrated in FIG. 1 (0100) may be converted into a ball-in-place frac plug. As generally seen in the flow chart of FIG. 12 (1200), a preferred exemplary bridge plug to a ball-in-place frac plug conversion method may be generally described in terms of the following steps:

(1) shipping a bridge plug to a job location as one piece (1201);
The bridge plug is shipped as a single piece so that there is no need for waiting on parts or waiting for missing parts to be assembled.

(2) removing a lower restriction element (1202);
Referring to FIG. 1 (0100), a lower restriction element (0124) may be removed by removing the stand-off pin (0116) and any screws (0115) holding the stand-off pin (0116). The stand-off pin may be re-inserted if there is a need. The stand-off pin must be inserted if the plug is a frac plug.

(3) removing a release ring (1203);
Referring to FIG. 1 (0100), a release ring (0102) may be unscrewed or other removal means from the body (0103) of the bridge plug.

(4) removing a cage retainer, a ball and a ball seat (1204);
Referring to FIG. 1 (0100), a cage retainer (0120) may be unscrewed or other removal means from the body (0103) of the bridge plug, followed by removing a ball (0117) and unscrewing a ball seat (0118) from the upper end of the mandrel.

(5) removing an upper restriction element (1205); and
Referring to FIG. 1 (0100), an upper restriction element (0122) may be removed by unscrewing or other removal means.

(6) re-installing the ball seat, the ball, and the release ring (1206).
Referring to FIG. 1 (0100), the ball seat (0118), the ball (0117), and the release ring (0102) may be reinstalled in that order so that the bridge plug is converted to a ball-in-place frac plug that enables fluid communication in at least one direction either upstream or downstream or both.

Exemplary Converted Ball-in-Place Frac Plug Embodiment (1300-1400)

Figure 13:
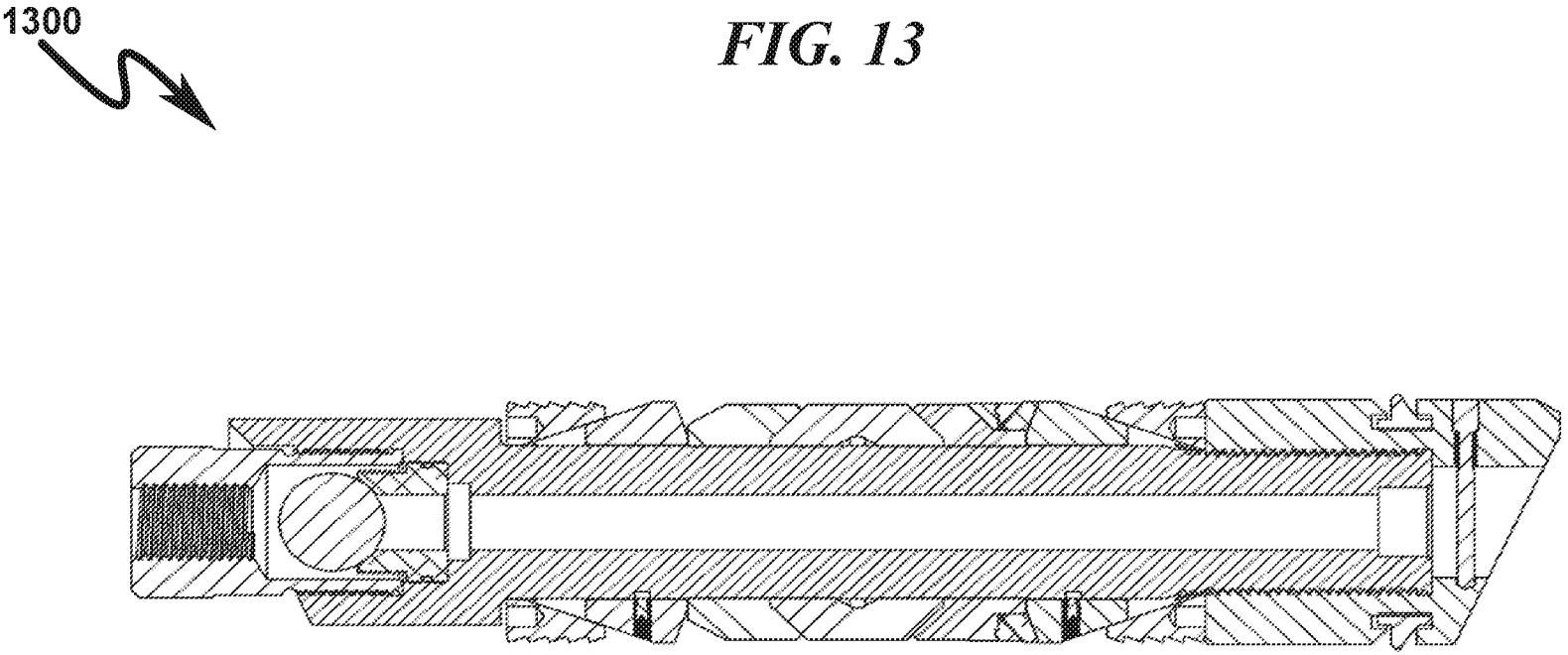
FIG. 13 illustrates an exemplary cross section view of a ball-in-place frac plug converted from a configurable bridge plug depicting a preferred embodiment of the present invention.
Figure 14:
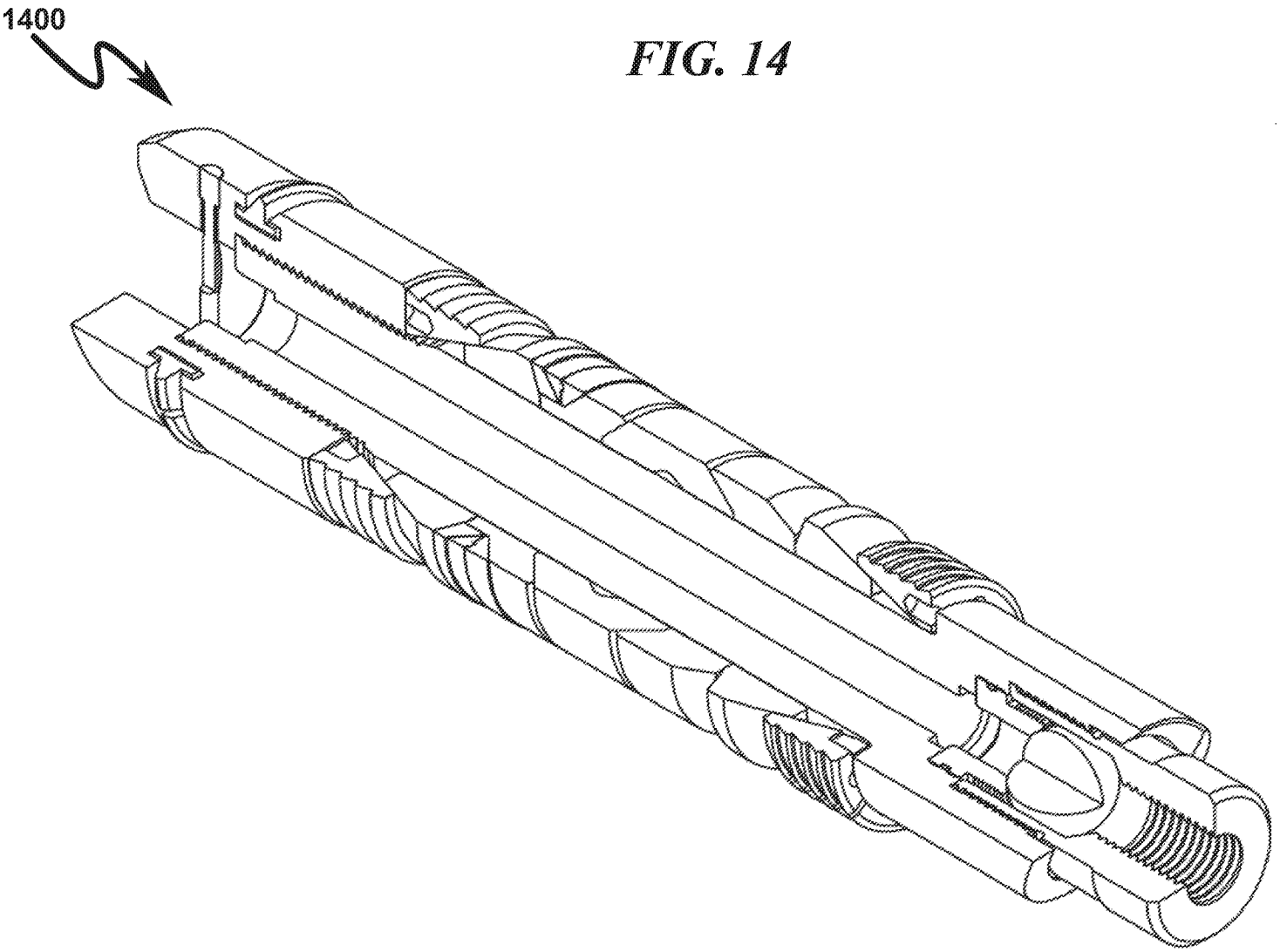
FIG. 14 illustrates an exemplary quarter section perspective view of a ball-in-place frac plug converted from a configurable bridge plug depicting a preferred embodiment of the present invention.

The bridge plug as illustrated in FIG. 1 (0100) may be converted into a ball-in-place frac plug by removing the upper restriction element and the lower restriction element. A converted caged frac plug is generally illustrated in FIG. 13 (1300). According to a preferred exemplary embodiment, the bridge plug may be shipped to the field or operations or an assembly shop as one single piece. The conversion process may include removing a stand-off pin followed by removing the lower restriction element. Likewise, the upper restriction element may be removed by removing the release ring, a cage retainer, ball and ball seat in that order. After removal of the upper restriction element, the release ring, the ball and ball seat may be re-installed. The converted ball-in-place plug may be used as frac plug that enables fluid communication in at least one direction. A quarter section perspective view of the converted ball-in-place frac plug is generally illustrated in FIG. 14 (1400).

Exemplary Bridge Plug to Ball-Drop Frac Plug Conversion Flowchart Embodiment (1500)

Figure 15:
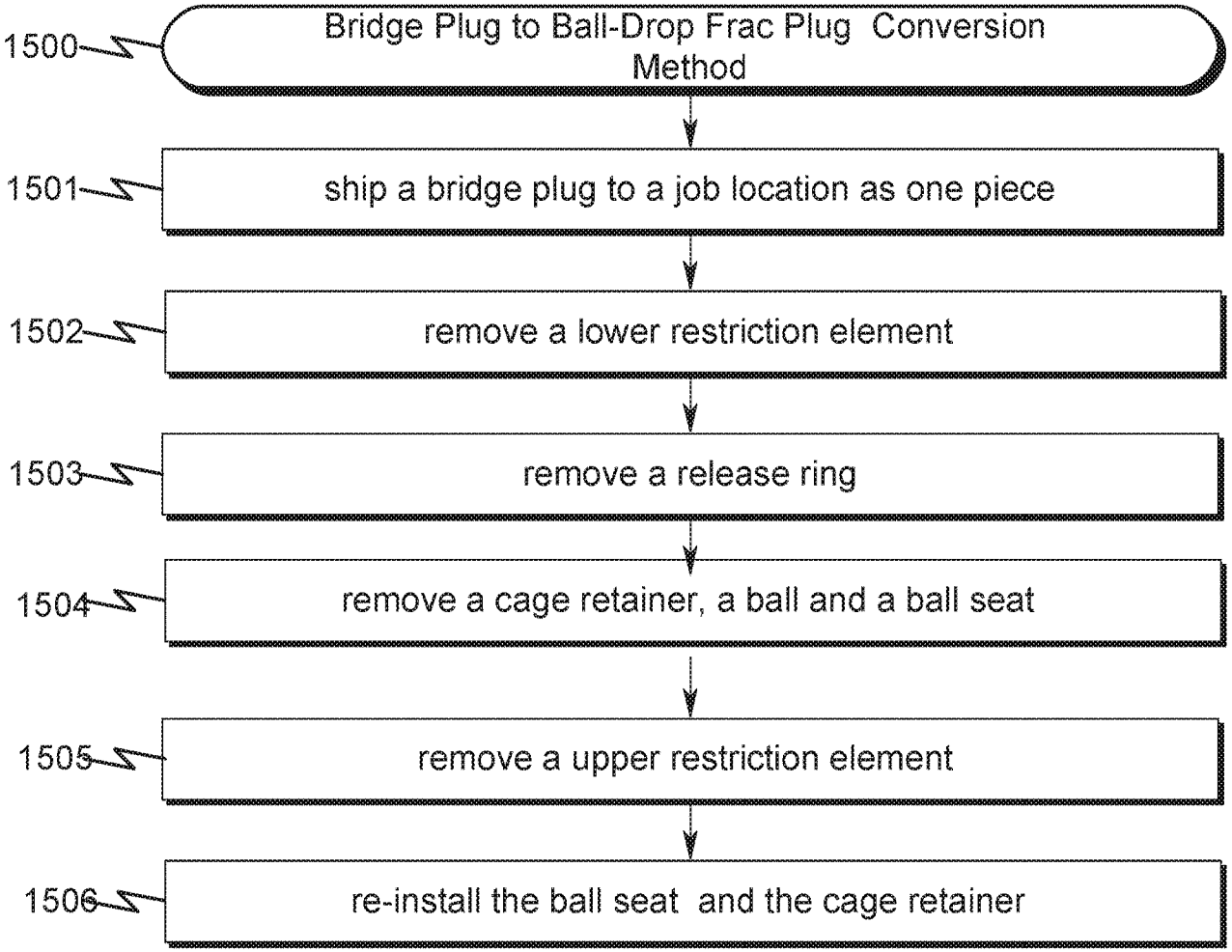
FIG. 15 illustrates a detailed flowchart of a preferred exemplary bridge plug to ball-drop frac plug conversion used in some preferred exemplary invention embodiments.

A composite configurable bridge plug as illustrated in FIG. 1 (0100) may be converted into a ball-drop frac plug. As generally seen in the flow chart of FIG. 15 (1500), a preferred exemplary bridge plug to a ball-in-place frac plug conversion method may be generally described in terms of the following steps:

(1) shipping a bridge plug to a job location as one piece (1501);
The bridge plug is shipped as a single piece so that there is no need for waiting on parts or waiting for missing parts to be assembled.

(2) removing a lower restriction element (1502);
Referring to FIG. 1 (0100), a lower restriction element (0124) may be removed by removing the stand-off pin (0116) and any screws (0115) holding the stand-off pin (0116). The stand-off pin may be re-inserted if there is a need. The stand-off pin must be inserted if the plug is a frac plug.

(3) removing a release ring (1503);
Referring to FIG. 1 (0100), a release ring (0102) may be unscrewed or other removal means from the body (0103) of the bridge plug.

(4) removing a cage retainer, a ball and a ball seat (1504);
Referring to FIG. 1 (0100), a cage retainer (0120) may be unscrewed or other removal means from the body (0103) of the bridge plug, followed by removing a ball (0117) and unscrewing a ball seat (0118) from the upper end of the mandrel.

(5) removing an upper restriction element (1505); and
Referring to FIG. 1 (0100), an upper restriction element (0122) may be removed by unscrewing or other removal means.

(6) re-installing the ball seat and the release ring (1506).
Referring to FIG. 1 (0100), the ball seat (0118), the ball (0117), and the release ring (0102) may be reinstalled in that order so that the bridge plug is converted to a ball-in-place frac plug that enables fluid communication in at least one direction either upstream or downstream or both.

Exemplary Converted Ball Drop Frac Plug Embodiment (1600-1700)

Figure 16:
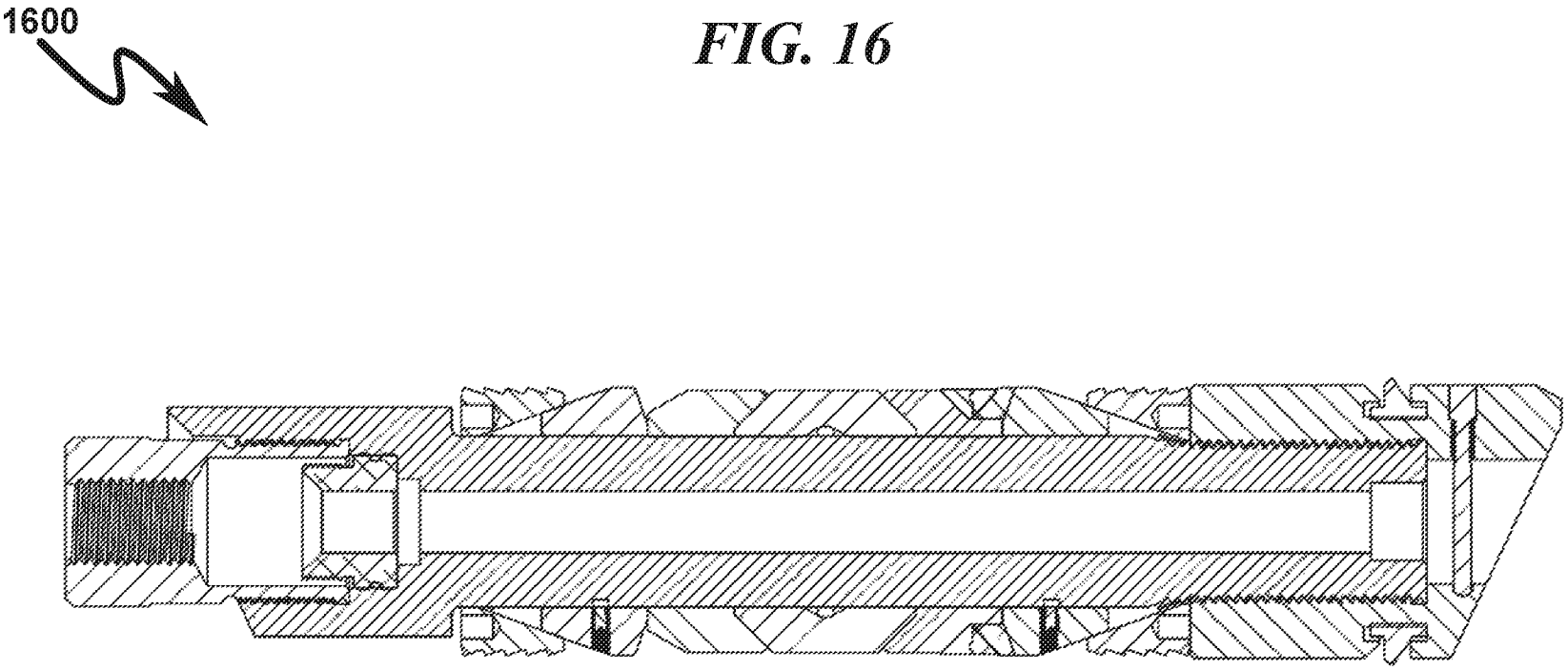
FIG. 16 illustrates an exemplary cross section view of a ball-drop frac plug converted from a configurable bridge plug depicting a preferred embodiment of the present invention.
Figure 17:
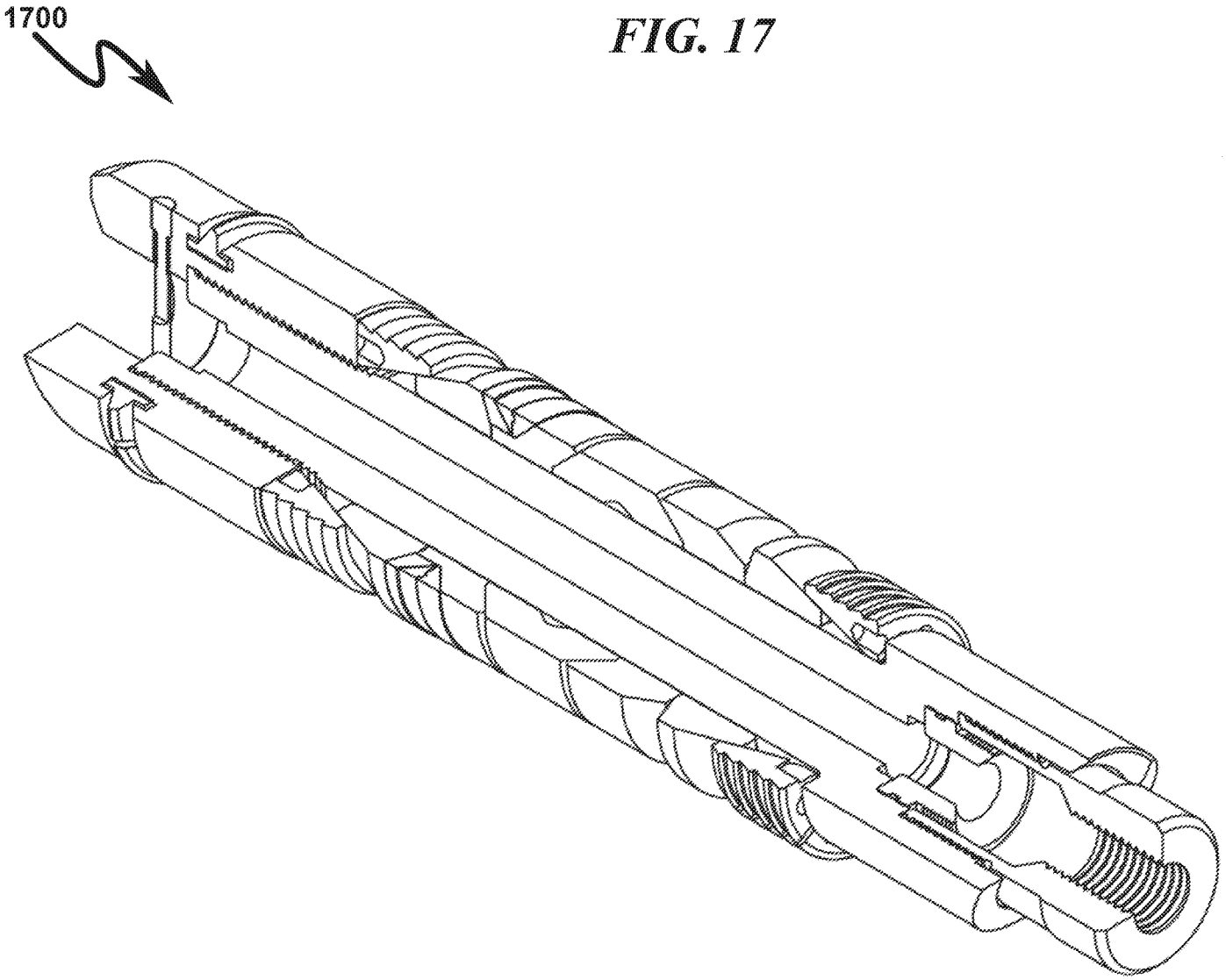
FIG. 17 illustrates an exemplary quarter section perspective view of a ball-drop frac plug converted from a configurable bridge plug depicting a preferred embodiment of the present invention.

The bridge plug as illustrated in FIG. 1 (0100) may be converted into a ball drop frac plug by removing the upper restriction element and the lower restriction element. A converted ball drop frac plug is generally illustrated in FIG. 16 (1600). According to a preferred exemplary embodiment, the bridge plug may be shipped to the field or operations or an assembly shop as one single piece. The conversion process may include removing a stand-off pin followed by removing the lower restriction element. Likewise, the upper restriction element may be removed by removing the release ring, a cage retainer, ball and ball seat in that order. After removal of the upper restriction element, the release ring and the ball seat may be re-installed. The converted ball drop plug may be used as frac plug that enables fluid communication in at least one direction. A quarter section perspective view of the converted ball drop frac plug is generally illustrated in FIG. 17 (1700).

Figure 18:
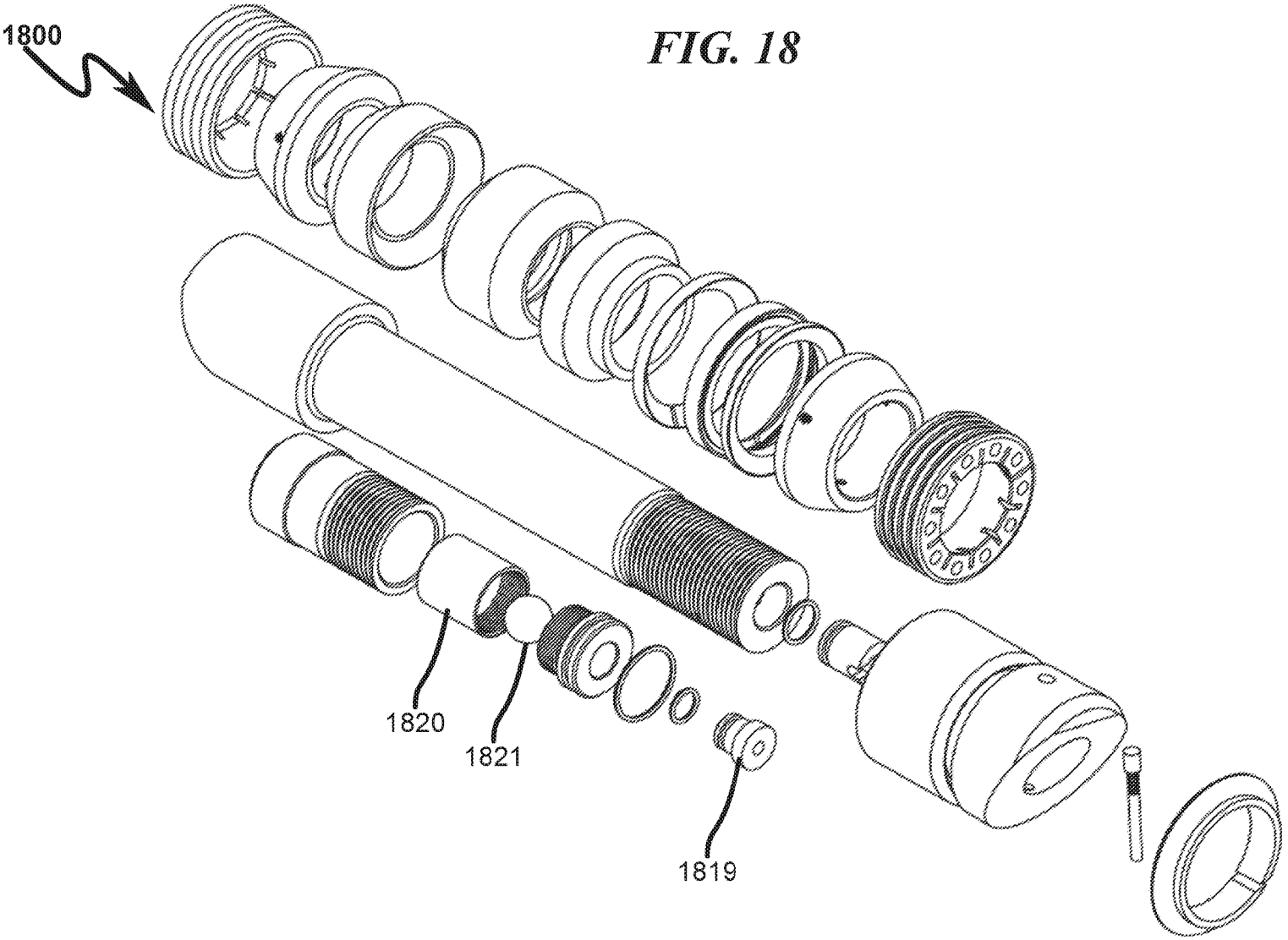
FIG. 18 illustrates an exemplary exploded view of a configurable bridge plug with all parts shipped depicting a preferred embodiment of the present invention.
Figure 19:
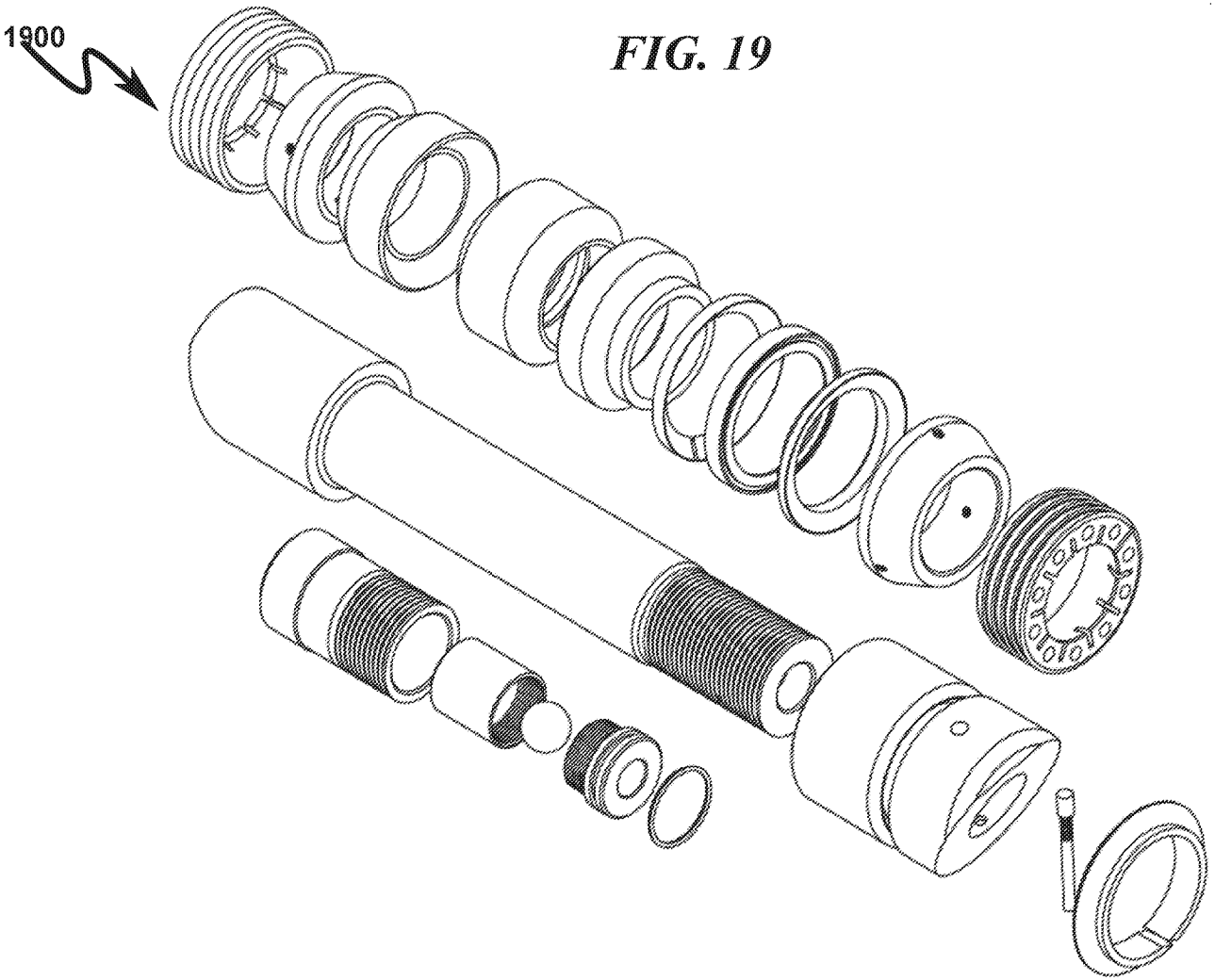
FIG. 19 illustrates an exemplary exploded view of caged ball frac plug configuration (with upper restriction plug removed from the bridge plug of FIG. 18) depicting a preferred embodiment of the present invention.
Figure 20:
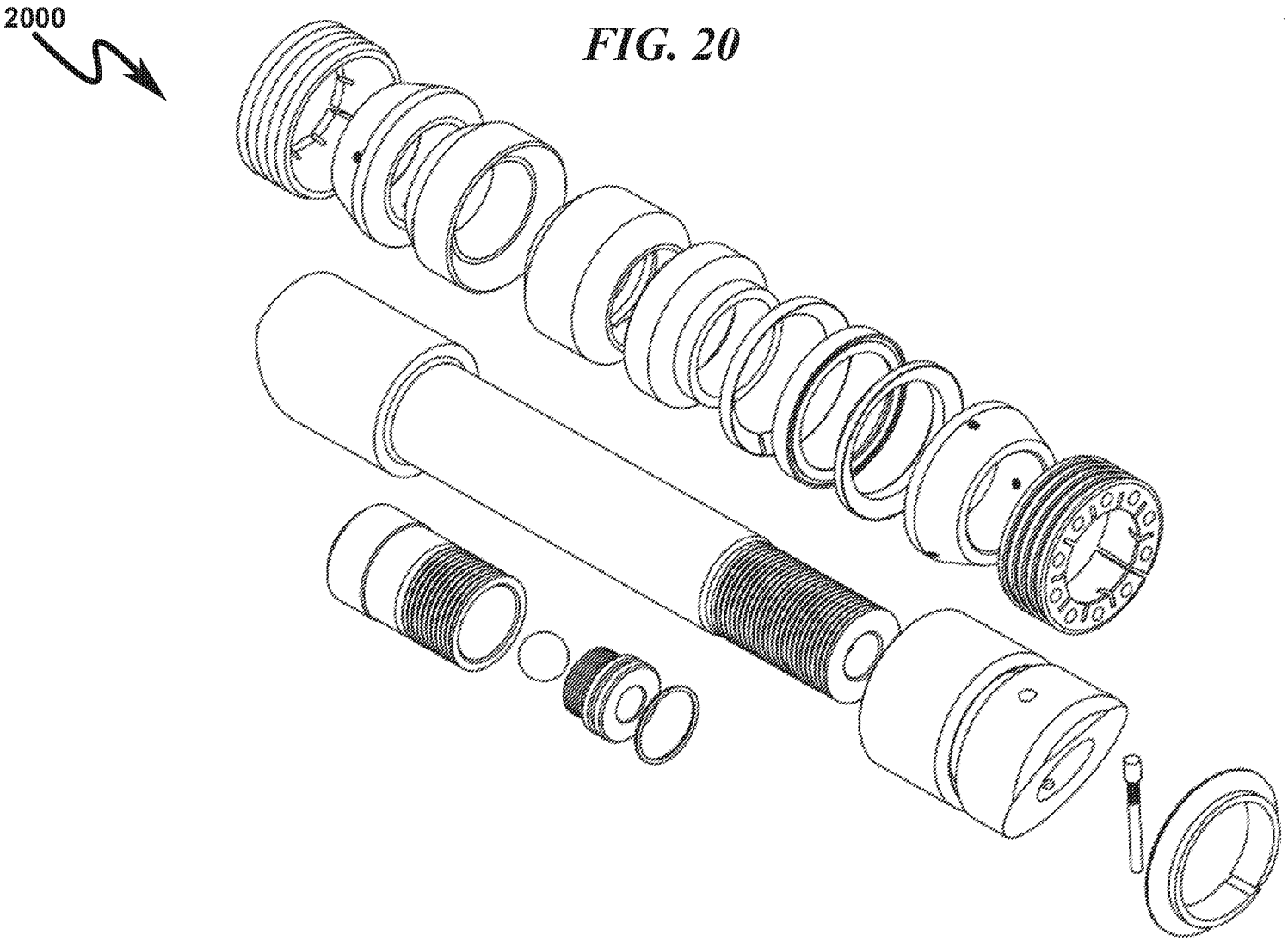
FIG. 20 illustrates an exemplary exploded view of ball in place frac plug configuration (with ball cage removed from the bridge plug of FIG. 18) depicting a preferred embodiment of the present invention.
Figure 21:
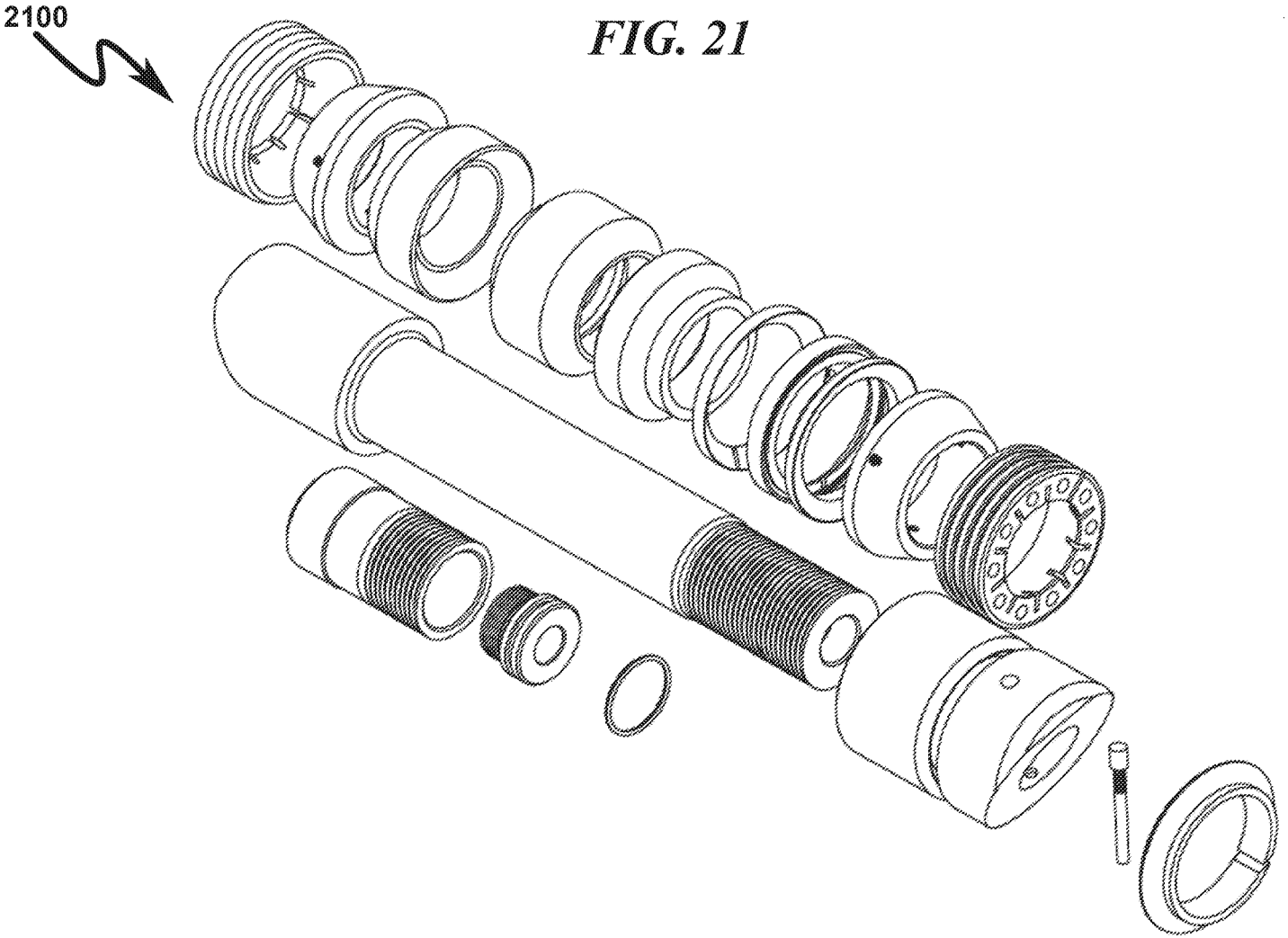
FIG. 21 illustrates an exemplary exploded view of frac plug configuration (with ball removed from the bridge plug of FIG. 18) depicting a preferred embodiment of the present invention.

As generally illustrated in FIG. 18-21, FIG. 18 is an exploded view of an exemplary bridge plug configuration with all shipping parts, FIG. 19 is exploded view of an exemplary caged ball frac plug configuration with upper restriction plugs removed, FIG. 20 is exploded view of an exemplary ball in place frac plug configuration with ball cage removed, and FIG. 21 is exploded view of an exemplary frac plug configuration with ball removed. The bridge plug illustrated in FIG. 18 is shipped to a job location where it may be converted to any of the plug illustrated in FIG. 19-21. The bridge plug of FIG. 18 may be converted to a caged ball plug of FIG. 19 by removing upper restriction plug (1819). The bridge plug of FIG. 18 may be converted to a ball in place of FIG. 20 by removing upper restriction plug (1819) and the ball cage (1820) removed. The bridge plug of FIG. 18 may be converted to a ball in place of FIG. 20 by removing upper restriction plug (1819), the ball cage (1820) and the ball (1821) removed.

Configurable Bridge Plug Apparatus Summary

The present invention system anticipates a wide variety of variations in the basic theme of extracting gas utilizing wellbore casings, but can be generalized as a configurable composite bridge plug for use as a downhole tool in a wellbore casing, the plug comprising:

(a) a body configured with a cylindrical hollow inner mandrel, an upper threaded end and a lower threaded end; the upper threaded end configured with inner threads disposed on an inner surface of the body;
(b) a release ring configured with outer threads disposed on an outer surface of the release ring; the outer threads configured to be threaded into the inner threads;
(c) an upper restriction element configured to plug an upper end of the hollow inner mandrel;
(d) a lower restriction element configured to plug a lower end of the hollow inner mandrel;
(e) a stand-off pin configured to restrain the lower restriction element in place;
(f) a ball seat configured to be inserted in a cavity in the upper threaded end proximal to the upper restriction element;
(g) a cage retainer configured to be mechanically coupled to the ball seat; and
(h) a ball configured to seat in the ball seat;

wherein the configurable bridge plug is configured to be transformed to a frac plug by removing the upper restriction element and the lower restriction element.

This general system summary may be augmented by the various elements described herein to produce a wide variety of invention embodiments consistent with this overall design description.

Restriction Plug Element Method Summary

The present invention method anticipates a wide variety of variations in the basic theme of implementation, but can be generalized as a conversion method utilized in the context of an overall gas extraction method, wherein the composite configurable bridge plug described previously is converted to a caged frac plug by a method having the following steps:

(1) shipping the bridge plug to a job location as one piece;
(2) removing the lower restriction element;
(3) removing the release ring;
(4) removing the cage retainer, the ball and the ball seat;
(5) removing the upper restriction element; and
(6) re-installing the ball seat, the ball, the cage retainer and the release ring.

This general method summary may be augmented by the various elements described herein to produce a wide variety of invention embodiments consistent with this overall design description.

Restriction Plug Element System/Method Variations

The present invention anticipates a wide variety of variations in the basic theme of oil and gas extraction. The examples presented previously do not represent the entire scope of possible usages. They are meant to cite a few of the almost limitless possibilities.

This basic system and method may be augmented with a variety of ancillary embodiments, including but not limited to:

An embodiment wherein the configurable bridge plug is configured to be transformed to a ball-in-place frac plug by removing the lower restriction element, the upper restriction element, and the cage retainer.

An embodiment wherein the configurable bridge plug is configured to be transformed to a ball-drop frac plug by removing the lower restriction element, the upper restriction element, the cage retainer, and the ball.

An embodiment wherein the release ring is further configured with a thin section; the thin section is configured to be substantially adjacent to the outer threads; and the thin section is configured with a groove;

wherein when the configurable composite bridge plug is set by a setting tool in the wellbore casing, the release ring shears at the groove in the thin section during removal of the setting tool.

An embodiment wherein outer threads enable to retain the cage retainer and the ball seat.

An embodiment wherein the bridge plug is configured to isolate fluid communication upstream and downstream of the bridge plug.

An embodiment wherein the upper restriction element and the lower restriction element on either sides of the hollow inner mandrel keeps the bridge plug intact when exposed to downhole pressures expected in the wellbore casing.

An embodiment wherein the lower restriction element enables use of a laminated material for the body such that the body is not exposed to higher differential pressure existing below the set the bridge plug from entering into the central hole inside the body and exerting a burst force.

An embodiment wherein the frac plug is configured to enable fluid communication in at least one direction.

An embodiment wherein the body is made from a composite material; the material selected from a group comprising: cast iron, composite glass, Aluminum, Magnesium, G10, Carbon Fiber, or Fiber Glass.

An embodiment wherein the upper restriction element and the lower restriction element are made from a composite material; the composite material selected from a group comprising: cast iron, composite glass, Aluminum, Magnesium, G10, Carbon Fiber, or Fiber Glass.

CONCLUSION

A configurable composite bridge plug apparatus and method for converting bridge plugs into frac plugs in the field of operation has been disclosed. The bridge plug apparatus includes a body with a cylindrical hollow inner mandrel, an upper threaded end and a lower threaded end. A release ring with threads disposed on an outer surface is attached to the upper threaded end. An upper restriction element and a lower restriction element plug attached to both ends of the hollow inner mandrel so that flow is restricted in either directions. A stand-off pin holds the lower restriction element in place. A ball seat inserted proximally to the upper restriction element towards the upper threaded end. A cage retainer is attached to the ball seat with a ball. The configurable bridge plug transformed to a frac plug by removing the upper restriction element and the lower restriction element from the bridge plug.

What is claimed is:

1. A configurable composite bridge plug for use as a downhole tool in a wellbore casing, said plug comprising:

(a) a body configured with a cylindrical hollow inner mandrel, an upper threaded end and a lower threaded end; said upper threaded end configured with inner threads disposed on an inner surface of said body;

(b) a release ring configured with outer threads disposed on an outer surface of said release ring; said outer threads configured to be threaded into said inner threads;

(c) an upper restriction element configured to plug an upper end of said hollow inner mandrel;

(d) a lower restriction element configured to plug a lower end of said hollow inner mandrel;

(e) a stand-off pin configured to restrain said lower restriction element in place;

(f) a ball seat configured to be inserted in a cavity in said upper threaded end proximal to said upper restriction element, the release ring retaining the ball seat within the cavity;

(g) a cage retainer configured to be mechanically coupled to said ball seat; and (h) a ball configured to seat in said ball seat;

wherein said configurable bridge plug is configured to be transformed to a frac plug by removing said upper restriction element and said lower restriction element.

2. The configurable composite bridge plug of claim 1 wherein said configurable bridge plug is configured to be transformed to a ball-in-place frac plug by removing said lower restriction element, said upper restriction element, and said cage retainer.

3. The configurable composite bridge plug of claim 1 wherein said configurable bridge plug is configured to be transformed to a ball-drop frac plug by removing said lower restriction element, said upper restriction element, said cage retainer, and said ball.

4. The configurable composite bridge plug of claim 1 wherein said release ring is further configured with a reduced thickness section; said reduced thickness section is configured to be substantially adjacent to said outer threads; and said reduced thickness section is configured with a groove;

wherein when said configurable composite bridge plug is set by a setting tool in said wellbore casing, said release ring shears at said groove in said reduced thickness section during removal of said setting tool.

5. The configurable composite bridge plug of claim 4 wherein outer threads enable the retention of said cage retainer and said ball seat.

6. The configurable composite bridge plug of claim 1 wherein said bridge plug is configured to isolate fluid communication upstream and downstream of said bridge plug.

7. The configurable composite bridge plug of claim 1 wherein said upper restriction element and said lower restriction element on either sides of said hollow inner mandrel keeps said bridge plug intact when exposed to downhole pressures expected in said wellbore casing.

8. The configurable composite bridge plug of claim 1 wherein said body is made from laminated material.

9. The configurable composite bridge plug of claim 1 wherein said frac plug is configured to enable fluid communication in at least one direction.

10. The configurable composite bridge plug of claim 1 wherein said body is made from a composite material; said material selected from a group comprising: cast iron, composite glass, Aluminum, Magnesium, G10, Carbon Fiber, or Fiber Glass.

11. The configurable composite bridge plug of claim 1 wherein said upper restriction element and said lower restriction element are made from a composite material; said composite material selected from a group comprising: cast iron, composite glass, Aluminum, Magnesium, G10, Carbon Fiber, or Fiber Glass.

12. A plug conversion method for converting a composite bridge plug into a caged ball frac plug, said bridge plug comprising:

(a) a body configured with a cylindrical hollow inner mandrel, an upper threaded end and a lower threaded end; said upper threaded end configured with inner threads disposed on an inner surface of said body;

(b) a release ring configured with outer threads disposed on an outer surface of said release ring; said outer threads configured to be threaded into said inner threads;

(c) an upper restriction element configured to plug an upper end of said hollow inner mandrel;

(d) a lower restriction element configured to plug a lower end of said hollow inner mandrel;

(e) a stand-off pin configured to restrain said lower restriction element in place;

(f) a ball seat configured to be inserted in a cavity in said upper threaded end proximal to said upper restriction element, the release ring retaining the ball seat within the cavity;

(g) a cage retainer configured to be mechanically coupled to said ball seat; and (h) a ball configured to seat in said ball seat;

wherein said method comprises the steps of:

(1) shipping said bridge plug to a job location as one piece;

(2) removing said lower restriction element;

(3) removing said release ring;

(4) removing said cage retainer, said ball and said ball seat;

(5) removing said upper restriction element; and (6) re-installing said ball seat, said ball, said cage retainer and said release ring.

13. A plug conversion method for converting a composite bridge plug into a ball-in-place frac plug, said bridge plug comprising:

(a) a body configured with a cylindrical hollow inner mandrel, an upper threaded end and a lower threaded end; said upper threaded end configured with inner threads disposed on an inner surface of said body;

(b) a release ring configured with outer threads disposed on an outer surface of said release ring; said outer threads configured to be threaded into said inner threads;

(c) an upper restriction element configured to plug an upper end of said hollow inner mandrel;

(d) a lower restriction element configured to plug a lower end of said hollow inner mandrel;

(e) a stand-off pin configured to restrain said lower restriction element in place;

(f) a ball seat configured to be inserted in a cavity in said upper threaded end proximal to said upper restriction element, the release ring retaining the ball seat within the cavity;

(g) a cage retainer configured to be mechanically coupled to said ball seat; and (h) a ball configured to seat in said ball seat;

wherein said method comprises the steps of:

(1) shipping said bridge plug to a job location as one piece;

(2) removing said lower restriction element;

(3) removing said release ring;

(4) removing said cage retainer, said ball and said ball seat;

(5) removing said upper restriction element; and (6) re-installing said ball seat, said ball, and said release ring.

14. A plug conversion method for converting a composite bridge plug into a ball-drop frac plug, said bridge plug comprising:

(a) a body configured with a cylindrical hollow inner mandrel, an upper threaded end and a lower threaded end; said upper threaded end configured with inner threads disposed on an inner surface of said body;

(b) a release ring configured with outer threads disposed on an outer surface of said release ring; said outer threads configured to be threaded into said inner threads;

(c) an upper restriction element configured to plug an upper end of said hollow inner mandrel;

(d) a lower restriction element configured to plug a lower end of said hollow inner mandrel;

(e) a stand-off pin configured to restrain said lower restriction element in place;

(f) a ball seat configured to be inserted in a cavity in said upper threaded end proximal to said upper restriction element, the release ring retaining the ball seat within the cavity;

(g) a cage retainer configured to be mechanically coupled to said ball seat; and (h) a ball configured to seat in said ball seat; wherein said method comprises the steps of:

(1) shipping said bridge plug to a job location as one piece;

(2) removing said lower restriction element;

(3) removing said release ring;

(4) removing said cage retainer, said ball and said ball seat;

(5) removing said upper restriction element; and (6) re-installing said ball seat and said release ring.

* * * * *